US012678702B2

(12) United States Patent
Dong

(10) Patent No.: US 12,678,702 B2
(45) Date of Patent: Jul. 14, 2026

(54) INTERLOCKING TOY

(71) Applicant: Yao Dong, Shantou (CN)

(72) Inventor: Yao Dong, Shantou (CN)

( * ) Notice: Subject to any disclaimer, the term of this patent is extended or adjusted under 35 U.S.C. 154(b) by 0 days.

(21) Appl. No.: 19/395,899

(22) Filed: Nov. 20, 2025

(65) Prior Publication Data

US 2026/0069995 A1 Mar. 12, 2026

(30) Foreign Application Priority Data

Sep. 10, 2025 (CN) ..... 202521951423.1

(51) Int. Cl.

| | |
|---|---|
| ***A61H 31/00*** | (2006.01) |
| ***A63H 17/00*** | (2006.01) |
| ***A63H 17/26*** | (2006.01) |
| ***A63H 31/00*** | (2006.01) |

(52) U.S. Cl.

CPC ..... *A63H 31/00* (2013.01); *A63H 17/002* (2013.01); *A63H 17/264* (2013.01)

(58) Field of Classification Search

CPC ..... A63H 31/00; A63H 31/06; A63H 31/08; A63H 33/04; A63H 33/042

See application file for complete search history.

(56) References Cited

U.S. PATENT DOCUMENTS 1,868,496 A * 7/1932 Gilbert ..... A63H 33/042 446/113
2,477,441 A * 7/1949 Cole ..... F16H 35/02 446/236
2,692,443 A * 10/1954 Milligan ..... G09B 25/02 434/401
2,994,154 A * 8/1961 Mccaa ..... A63H 33/042 248/220.42
3,172,666 A * 3/1965 Ryan ..... G09B 25/02 273/287
5,073,138 A * 12/1991 Klitsner ..... A63H 31/00 446/105
5,194,031 A * 3/1993 Sahler ..... A63H 31/00 74/439
5,651,745 A * 7/1997 Childress ..... G09B 25/02 474/190
5,759,081 A * 6/1998 Lyman ..... A63H 31/00 434/401
6,183,332 B1 * 2/2001 Yamazaki ..... A63H 31/00 446/92

(Continued)

*Primary Examiner* — Kurt Fernstrom

(57) ABSTRACT

An interlocking toy is provided. A plurality of connection assemblies of a torque transferring device are arranged on the interlocking toy. Each connection assembly is provided with two connection ends, and a plurality of fitting ends are provided on a supporting seat. Each fitting end is configured for detachable insertion of the connection ends. Thus, transmission devices are allowed to be replaced or rearranged, which improves transformability of the toy and enhances transformation flexibility of a product. Second, when any connection assembly is in plug-in fit with the fitting ends of two supporting seats respectively through the two connection ends, a relative position between the two supporting seats is fixed, so that outer tooth rings of two rotating seats are engaged with each other, and then two transmission devices are in driving connection to each other.

20 Claims, 23 Drawing Sheets

(56) References Cited

U.S. PATENT DOCUMENTS

| | | | | |
|---|---|---|---|---|
| 6,773,323 | B1 * | 8/2004 | Huang | A63H 31/00 446/124 |
| 10,143,931 | B2 * | 12/2018 | Wang | A63H 33/105 |
| 10,699,597 | B2 * | 6/2020 | Karol | G09B 23/00 |
| 12,311,285 | B2 * | 5/2025 | Zhang | F16H 19/00 |
| 12,465,872 | B2 * | 11/2025 | Lin | A63H 33/22 |
| 2009/0004946 | A1 | 1/2009 | Sinisi et al. | |
| 2011/0133406 | A1 * | 6/2011 | Chiu | A63F 9/0819 273/276 |
| 2019/0143236 | A1 * | 5/2019 | Cecchin | H01R 39/64 446/90 |
| 2020/0254357 | A1 | 8/2020 | Hart et al. | |
| 2021/0394076 | A1 | 12/2021 | Hart et al. | |
| 2024/0054914 | A1 * | 2/2024 | Rupp | A63H 33/042 |

* cited by examiner

INTERLOCKING TOY

TECHNICAL FIELD

The present disclosure relates to the field of toys, and in particular, to an interlocking toy.

BACKGROUND

An existing toy is usually provided with various action devices which can be caused to perform corresponding actions after a torque is inputted to the action devices. However, the existing action devices still have shortcomings in practical applications:

First, once the action devices are assembled, the action devices cannot be replaced or rearranged. As a result, the toy has low transformability.

Second, if the toy is provided with a plurality of action devices, and actions of the action devices are different, it a corresponding torque inputting structure needs to be configured for each action device. Consequently, a product has high manufacturing costs and also has reduced compactness due to the different torque inputting structures.

SUMMARY

The present disclosure provides an interlocking toy which can solve the problems of low transformability, high manufacturing costs, and low compactness of the toy.

The present disclosure provides an interlocking toy, including:

a torque transferring device, including a plurality of connection assemblies, where each connection assembly is provided with two connection ends;

a plurality of transmission devices, where each transmission device includes a supporting seat, a rotating seat, a transmission gear, and an output member; the supporting seat is provided with a plurality of fitting ends; each fitting end is configured for detachable insertion of the connection ends; the rotating seat has an outer tooth ring and an inner tooth ring; the rotating seat is rotatably arranged on the supporting seat; the transmission gear is rotatably arranged on the supporting seat; the transmission gear is engaged with the inner tooth ring; the transmission gear is in driving connection to the output member; and a plurality of action devices, where the action devices are movably arranged on the supporting seats in a one-to-one correspondence manner, and the action devices are in driving connection to the output members in a one-to-one correspondence manner, where when any connection assembly is in plug-in fit with the fitting ends of two supporting seats respectively through the two connection ends, a relative position between the two supporting seats is fixed, so that two outer tooth rings are engaged with each other, and then two transmission devices are in driving connection to each other.

Preferably, each output member includes a rotating wheel and an eccentric shaft; each transmission device further includes a transmission shaft; the transmission shaft is threaded and fixed in the transmission gear; the transmission shaft is rotatably arranged on the supporting seat, and the transmission shaft is fixedly connected to the rotating wheel; the eccentric shaft is arranged on the rotating wheel; the eccentric shaft is in driving connection to the action device; or each output member includes a rotating wheel and an eccentric shaft; each transmission device further includes a transmission shaft that is integrally formed on the transmission gear; the transmission shaft is rotatably arranged on the supporting seat, and the transmission shaft is fixedly connected to the rotating wheel; the eccentric shaft is arranged on the rotating wheel; and the eccentric shaft is in driving connection to the action device.

Preferably, a driving channel is formed in each action device; the eccentric shaft is movably inserted into the driving channel; and when the transmission gear is driven to rotate by the rotating seat, the rotating wheel is driven to rotate through the transmission shaft, so that the rotating wheel drives the eccentric shaft to move along the driving channel, and the eccentric shaft drives the action device to move by pressing an inner wall of the driving channel.

Preferably, each action device includes a mounting shell, a sliding seat, and at least one swinging member; the driving channel and at least one limiting slot are formed in the sliding seat; each swinging member is provided with a swinging part;

the mounting shell is arranged on the supporting seat; the sliding seat is slidably arranged on the mounting shell; each swinging member is rotatably arranged on the mounting shell; the swinging part is located in the limiting slot; and when the sliding seat is driven to slide by the eccentric shaft, the sliding seat drives the swinging part through a slot wall of the limiting slot, so that the swinging part drives the swinging member to rotate relative to the mounting shell.

Preferably, at least one U-shaped protrusion is arranged on the sliding seat; each U-shaped protrusion defines the limiting slot on the sliding seat; the U-shaped protrusion movably resists against the swinging part; and/or, the sliding seat is provided with three limiting slots; the action device includes three swinging members; the three swinging members are respectively rotatably arranged on the mounting shell; and the three swinging parts are movably arranged in the three limiting slots in a one-to-one correspondence manner.

Preferably, an arc-shaped guide hole is formed in each supporting seat;

each action device includes a fixed member and a rotary member; the fixed member is fixedly arranged on the supporting seat; the driving channel is located on the rotary member; the rotary member is provided with a rotary connection part and a movable connection part; the rotary connection part is rotatably connected to the fixed member or the supporting seat; the movable connection part is movably inserted into the arc-shaped guide hole; and when the eccentric shaft drives the rotary member by pressing the inner wall of the driving channel, the rotary member rotates around the rotary connection part, and the movable connection part slides along the arc-shaped guide hole.

Preferably, an avoidance hole is formed in the fixed member, and the rotary member is threaded into the avoidance hole and is exposed out of the fixed member; or, an avoidance slot is formed in the fixed member; and the rotary member is at least partially located in the avoidance slot.

Preferably, each output member includes an output gear and an output shaft; the output gear is rotatably arranged on the supporting seat, and the output gear is engaged with the transmission gear; the output shaft is arranged on the output gear; and the output shaft is in driving connection to the action device.

Preferably, each action device includes a supporting shell, a plurality of rotating gears, and a plurality of rotating members;

the supporting shell is arranged on the supporting seat; the rotating gears are respectively rotatably arranged on the supporting shell, and are engaged with each other; each output shaft is in driving connection to one rotating gear; the rotating members are arranged on the rotating gears in a one-to-one correspondence manner; and when the output shaft rotates, the output shaft drives the rotating gears to rotate, to drive the rotating members to rotate.

Preferably, at least one insertion hole is formed in each rotating gear, and the rotating members are inserted into the insertion holes in a one-to-one correspondence manner; and/or, the output shaft is fixedly inserted into one rotating gear; and/or, the output gear and the output shaft are of integrally formed structures.

Preferably, each action device includes a fixed shell, a first reversing gear, a plurality of second reversing gears, and a plurality of reversing moving members;

the fixed shell is arranged on the supporting seat; the first reversing gear is connected to the output shaft; the second reversing gears are respectively rotatably arranged on the fixed shell; one second reversing gear is engaged with the first reversing gear, and the second reversing gears are engaged with each other; the reversing moving members are respectively arranged on the second reversing gears; a central axis of the first reversing gear is not parallel to a central axis of any second reversing gear; and when the output shaft drives the first reversing gear to rotate, the first reversing gear drives the second reversing gears to rotate, to cause the reversing moving members to rotate relative to the fixed shell.

Preferably, the output shaft is fixedly arranged on the first reversing gear; an output hole is formed in the output gear; and the output shaft is inserted into the output hole.

Preferably, an avoidance slot is formed in the fixed shell; a via hole is formed in the avoidance slot;

the first reversing gear is located in the avoidance slot; and the first reversing gear is threaded into the via hole to be engaged with the second reversing gear.

Preferably, a plurality of through holes are formed in the fixed shell; the reversing moving members are threaded into the through holes in a one-to-one correspondence manner; and the reversing moving members are exposed out of the fixed shell.

Preferably, each supporting seat includes a base and a cover body; the fitting ends are located at a bottom of the supporting seat; each transmission gear is rotatably arranged between the base and the cover body; each rotating seat sleeves the cover body; the rotating seat is partially clamped between the base and the cover body; each output member is arranged on the cover body;

a notch is formed in the base or the cover body; the notch is aligned with the inner tooth ring; the transmission gear is threaded out of the notch and is engaged with the inner tooth ring; and each action device is arranged on the cover body.

Preferably, an accommodating slot is formed in a top of the cover body; and the output member is located inside the accommodating slot.

Preferably, each connection assembly includes a connector; the two connection ends are respectively located on the connector; each connection end is provided with a connection column;

central axes of the two connection columns are parallel to each other and do not overlap; or the central axes of the two connection columns form a right angle.

Preferably, the torque transferring device includes a plurality of transmission assemblies; each transmission assembly includes a connection seat and a transmission member; a plurality of positioning ends are provided on the connection seat; the positioning ends are configured for plug-in fit of the connection ends; a transmission tooth structure is arranged on the transmission member;

when any connection assembly is in plug-in fit with the positioning ends on the transmission assembly through one connection end, and is in plug-in fit with the fitting ends through the other connection end, a relative position between the connection seat and the supporting seat is fixed, and the transmission tooth structure is engaged with the outer tooth ring, so that the transmission assembly is in driving connection to the transmission device;

when any connection assembly is respectively in plug-in fit with two transmission assemblies, a relative position between the two connection seats is fixed, and the two transmission tooth structures are engaged with each other, so that the two transmission assemblies are in driving connection to each other.

Preferably, the interlocking toy further includes a vehicle body and a driving device;

at least some of the connection seats are arranged on the vehicle body;

the driving device includes a motor and a plurality of driving gears; the motor is arranged on the vehicle body; the driving gears are respectively rotatably arranged on the vehicle body; the driving gears are engaged with each other in sequence; the motor is in driving connection to one driving gear; and another driving gear is in driving connection to the transmission members.

Preferably, the vehicle body includes a plurality of vehicle assemblies; the vehicle assemblies are detachably connected to each other;

the driving device is arranged on one vehicle assembly; and the connection seats are arranged on at least some of the vehicle assemblies.

The present disclosure has the following beneficial effects:

An interlocking toy is provided. A plurality of connection assemblies of a torque transferring device are arranged on the interlocking toy. Each connection assembly is provided with two connection ends, and a plurality of fitting ends are provided on a supporting seat. Each fitting end is configured for detachable insertion of the connection ends. Thus, transmission devices are allowed to be replaced or rearranged, which improves transformability of the toy and enhances transformation flexibility of a product.

Second, when any connection assembly is in plug-in fit with the fitting ends of two supporting seats respectively through the two connection ends, a relative position between the two supporting seats is fixed, so that outer tooth rings of two rotating seats are engaged with each other, and then two transmission devices are in driving connection to each other.

Thus, a single torque inputting structure outputs a torque to the transmission devices that are engaged with each other, and the torque is then further distributed to the action devices. In this way, arrangement of a plurality of independent torque inputting structures is reduced, which means that arrangement of a plurality of motors is avoided. Manufacturing costs of the product are greatly reduced, and compactness of the product is improved.

BRIEF DESCRIPTION OF THE DRAWINGS

The exemplary implementations of the present disclosure will be described in more details by combining the accompanying drawings. The above and other objectives, features, and advantages of the present disclosure will become more obvious. In the exemplary implementations of the present disclosure, the same reference numerals generally represent the same components.

DETAILED DESCRIPTION OF THE EMBODIMENTS

Figure 1:
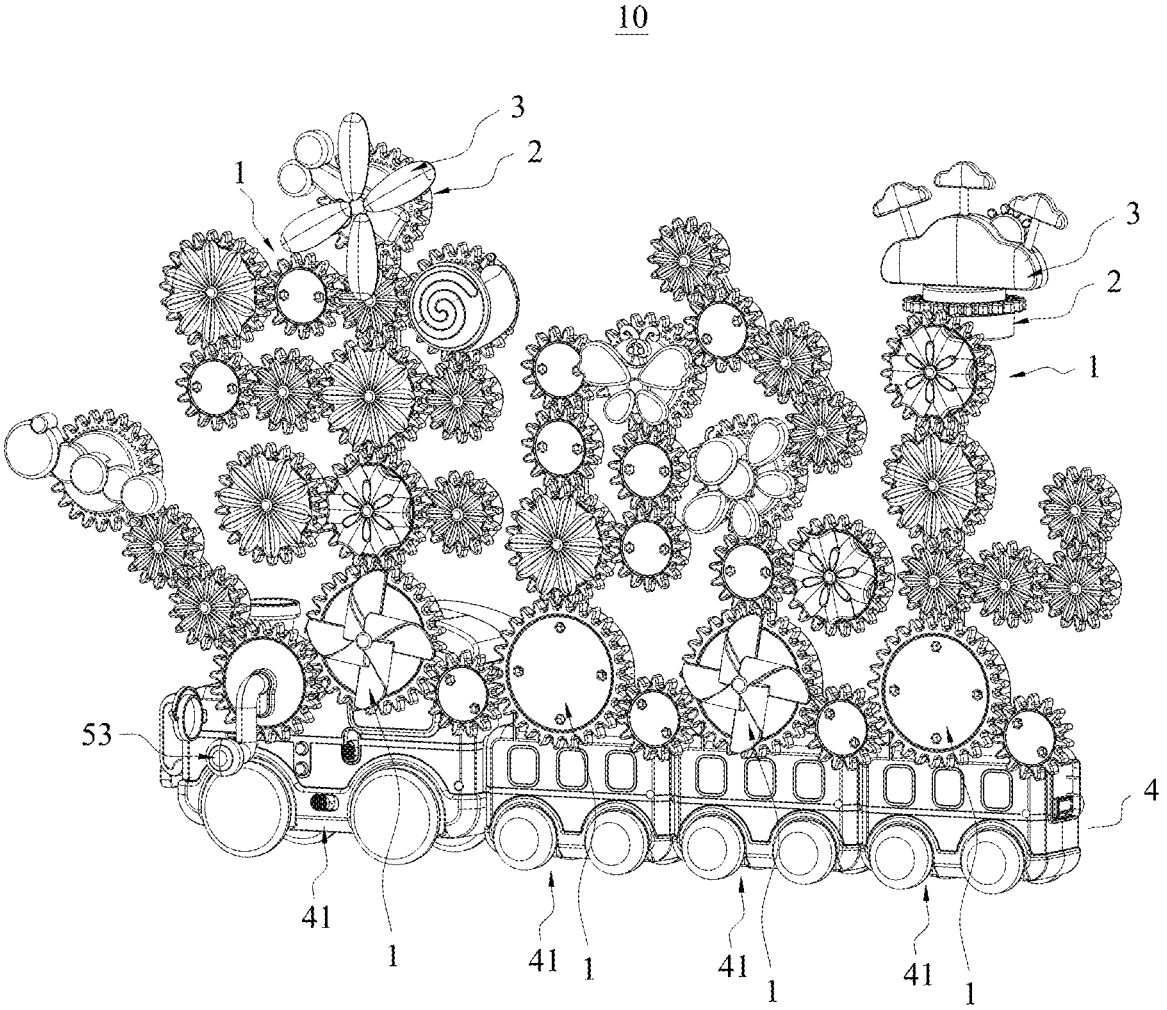
FIG. 1 is a schematic structural diagram of an interlocking toy in some embodiments of the present disclosure.

The implementations of the present disclosure will be described in more details below with reference to the accompanying drawings. Although the accompanying drawings show the exemplary implementations of the present disclosure, it should be understood that the present disclosure can be implemented in various forms, and should not be limited to the implementations stated herein. Rather, these implementations are provided for understanding the present disclosure more thoroughly and completely, and can completely transfer the scope of the present disclosure to those skilled in the art.

It should be understood that although various information may be described using terms such as "first", "second", and "third" in the present disclosure, such information should not be limited to these terms. These terms are only used to distinguish information of the same type from each other. For example, without departing from the scope of the present disclosure, the first information can also be referred to as the second information, and similarly, the second information can also be referred to as the first information. Thus, features defined as "first" and "second" explicitly or implicitly include one or more of the features. In the description of the present disclosure, "plurality" means two or more, unless otherwise expressly and specifically defined.

In the descriptions of the present disclosure, it should be understood that orientations or positional relationships indicated by the terms "length", "width', "upper", "lower", "front", "rear", "left", "right", "vertical", "horizontal", "top", "bottom", "inner", "outer", and the like are orientations or positional relationships as shown in the drawings, and are only for the purpose of facilitating and simplifying the descriptions of the present disclosure instead of indicating or implying that devices or elements indicated must have particular orientations, and be constructed and operated in the particular orientations, so that these terms are not construed as limiting the present disclosure.

Unless otherwise expressly specified and limited, the terms "mount", "connect", "connection", "fix" the like should be understood in a broad sense, such as, a fixed connection, a detachable connection, an integrated connection, a mechanical connection, an electrical connection, a direct connection, an indirect connection through an intermediate medium, an internal communication of two elements, or interaction between two elements. For those of ordinary skill in the art, the specific meanings of the aforementioned terms in the present disclosure can be understood based on specific conditions.

FIG. 1 to FIG. 6 show an interlocking toy 10 in some embodiments of the present disclosure. The interlocking toy 10 includes a torque transferring device 1, a plurality of transmission devices 2, and a plurality of action devices 3. The torque transferring device 1 is configured to connect the transmission devices 2, thereby implementing power transferring between the transmission devices 2. The action devices 3 are arranged on the transmission devices 2, and are configured to: receive a torque transferred through the transmission devices 2 and perform corresponding actions.

It should be noted that the torque transferring device 1 is configured to establish a detachable mechanical connection and a torque transferring path between the transmission devices 2. Through plug-in fit, a user is allowed to freely combine a physical arrangement sequence and relative positions of the plurality of transmission devices 2, and re-establish a power transferring path.

The transmission devices 2 are used as power conversion and distribution hubs to distribute an inputted torque to the action devices 3 after the inputted torque is converted by an internal gear mechanism. The action devices 3 are used as modules for performing specific actions: receiving an outputted torque distributed by the transmission devices 2 and converting a rotation motion into a specific functional action. This reflects the interactivity and playability of the toy.

Referring to FIG. 1 to FIG. 8 together, the torque transferring device 1 includes a plurality of connection assemblies 11. Each connection assembly 11 is provided with two connection ends 1111.

Referring to FIG. 4 to FIG. 23, each transmission device 2 includes a supporting seat 21, a rotating seat 22, a transmission gear 23, and an output member 24. The supporting seat 21 is provided with a plurality of fitting ends 2121. Each fitting end 2121 is configured for detachable insertion of the connection ends 1111. The rotating seat 22 has an outer tooth ring 221 and an inner tooth ring 222. The rotating seat 22 is rotatably arranged on the supporting seat 21. The transmission gear 23 is rotatably arranged on the supporting seat 21. The transmission gear 23 is engaged with the inner tooth ring 222. The transmission gear 23 is in driving connection to the output member 24.

The action devices 3 are movably arranged on the supporting seats 21 in a one-to-one correspondence manner, and the action devices 3 are in driving connection to the output members 24 in a one-to-one correspondence manner.

When any connection assembly 11 is in plug-in fit with the fitting ends 2121 of two supporting seats 21 respectively through the two connection ends 1111, a relative position between the two supporting seats 21 is fixed, so that two outer tooth rings 221 are engaged with each other, and then two transmission devices 2 are in driving connection to each other.

It can be understood that the two connection ends 1111 of the connection assembly 11 are configured for detachable insertion with the fitting ends 2121 of different supporting seats 21, thus implementing physical connection between the transmission devices 2 and fixing the relative position between the transmission devices 2.

The fitting ends 2121 are configured to provide standardized interfaces for insertion connection of the connection ends 1111, which allows the connection assembly 11 to select different insertion positions according to a need, thereby adjusting relative angles of the transmission devices 2.

When the two supporting seats 21 are fixed by the connection assembly 11, adjacent outer tooth rings 221 (the two transmission devices 2 connected by the connection assembly 11) are engaged each other, to directly transfer a rotation torque. The inner tooth rings 222 are engaged with the transmission gears 23, and transfer a torque inputted by the outer tooth rings 221 to the transmission gears 23.

The transmission gears 23 receive the torque of the inner tooth ring 222. When rotating, the rotating seats 22 can drive the transmission gears 23 to rotate through the inner tooth rings 222. The transmission gears 23 can transfer the torque to the output members 24, and the output members 24 further transfer the torque to the corresponding action devices 3, to cause the corresponding action devices to perform predetermined actions.

It should be noted that the connection assembly 11 fixes the two supporting seats 21, which can implement physical positioning of the two supporting seats 21 and forcibly align the outer tooth rings 221 of the two rotating seats 22 to ensure their precise engagement. In this case, the torque can be transferred between devices through the engagement of the outer tooth rings 221, thus forming a power transferring path. A first transmission device 2 receives an external inputted torque (for example, a torque inputted in a motor driving or manual driving manner), and transfers the external inputted torque to an adjacent transmission device 2 through the engagement of the outer tooth rings 221. The external inputted torque is then transferred to the transmission gear 23 through the inner tooth ring 222, and the transmission gear 23 transfers the torque to the output member 24. The torque is finally distributed to all the connected action devices 3.

It should also be noted that in one aspect, a plurality of connection assemblies of a torque transferring device are arranged on the interlocking toy in this embodiment. Each connection assembly is provided with two connection ends, and a plurality of fitting ends are provided on a supporting seat. Each fitting end is configured for detachable insertion of the connection ends. Thus, transmission devices are allowed to be replaced or rearranged, which improves transformability of the toy and enhances transformation flexibility of a product.

In another aspect, when any connection assembly is in plug-in fit with the fitting ends of two supporting seats respectively through the two connection ends, a relative position between the two supporting seats is fixed, so that outer tooth rings of two rotating seats are engaged with each other, and then two transmission devices are in driving connection to each other. Thus, a single torque inputting structure outputs a torque to the transmission devices that are engaged with each other, and the torque is then further distributed to the action devices. In this way, arrangement of a plurality of independent torque inputting structures is reduced, which means that arrangement of a plurality of motors is avoided. Manufacturing costs of the product are greatly reduced, and compactness of the product is improved.

As shown in FIG. 6 and FIG. 9 to FIG. 18, in some embodiments of the interlocking toy 10, each output member 24 includes a rotating wheel 241 and an eccentric shaft 242. Each transmission device 2 further includes a transmission shaft 25. The transmission shaft 25 is threaded and fixed in the transmission gear 23. The transmission shaft 25 is rotatably arranged on the supporting seat 21, and the transmission shaft 25 is fixedly connected to the rotating wheel 241. The eccentric shaft 242 is arranged on the rotating wheel. The eccentric shaft 242 is in driving connection to the action device 3.

It can be understood that the transmission shaft 25 is configured to be threaded and fixed in the transmission gear 23. A rotation motion of the transmission gear 23 is coaxially transferred to the rotating wheel 241 to implement rigid synchronization of power outputting. The rotating wheel 241 rotates to drive the eccentric shaft 242 to do circumferential motion, and constant-speed rotation of the transmission shaft 25 is converted into eccentric displacement.

Since the eccentric shaft 242 deviates from a circle center of the rotating wheel 241, the eccentric shaft 242 has a periodic displacement change during rotating, to provide a driving force for the action device 3.

It should be noted that in this embodiment, the transmission shaft 25 drives the rotating wheel 241, and the rotating wheel 241 drives the eccentric shaft 242 to do the circumferential motion, thus efficiently converting a torque of the rotating seat 22 into eccentric circumferential motion. The circumferential motion of the eccentric shaft 242 can drive the action device 3 to complete a cyclic action.

In some other embodiments, each output member 24 includes a rotating wheel 241 and an eccentric shaft 242. Each transmission device 2 further includes a transmission shaft 25 that is integrally formed on the transmission gear 23. The transmission shaft 25 is rotatably arranged on the supporting seat 21, and the transmission shaft 25 is fixedly connected to the rotating wheel 241. The eccentric shaft 242 is arranged on the rotating wheel. The eccentric shaft is in driving connection to the action device.

It can be understood that compared with the foregoing embodiment, this embodiment provides the transmission shaft 25, but the transmission shaft 25 and the transmission gear 23 are manufactured together in an integral forming manner, so that tedious assembling of parts can be avoided, and production and assembling efficiency of a product can be improved. Furthermore, consistency of parts can be improved, and negative effects on torque transferring due to an assembling error or a part fit clearance can be avoided.

In addition, it should also be noted that no matter the transmission shaft 25 is integrally formed on the transmission gear or is later assembled on the transmission gear, a length of the transmission shaft 25 can be flexibly set, which is specifically flexibly adjusted based on a specific structure of the product, an arrangement position of the transmission gear, a design requirement, or the like. Certainly, in some embodiments, the transmission shaft 25 and the transmission gear are manufactured in a uniform specification, so that they do not be machined and manufactured for parts of different specifications. This improves the consistency of parts, reduces production costs, and improves working efficiency.

As shown in FIG. 9 to FIG. 18, in some embodiments of the interlocking toy 10, a driving channel 333 is formed in each action device 3. The eccentric shaft 242 is movably inserted into the driving channel 333.

When the transmission gear 23 is driven to rotate by the rotating seat 22, the rotating wheel 241 is driven to rotate through the transmission shaft 25, so that the rotating wheel 241 drives the eccentric shaft 242 to move along the driving channel 333, and the eccentric shaft 242 drives the action device 3 to move by pressing an inner wall of the driving channel 333.

It can be understood that the driving channel 333 is used as a guide track on the action device 3, and can convert the circumferential motion into a linear or curved trajectory output by cooperation with the eccentric shaft 242. When the eccentric shaft 242 slides inside the driving channel 333, the eccentric shaft 242 continuously applies a pushing force through a side wall of the driving channel 333, to force the action device 3 to move in a preset direction.

It should be noted that in this embodiment, conversion between a rotation motion and a linear/nonlinear motion is implemented through a slidable pushing mechanism between the eccentric shaft 242 and the driving channel 333.

Figure 9:
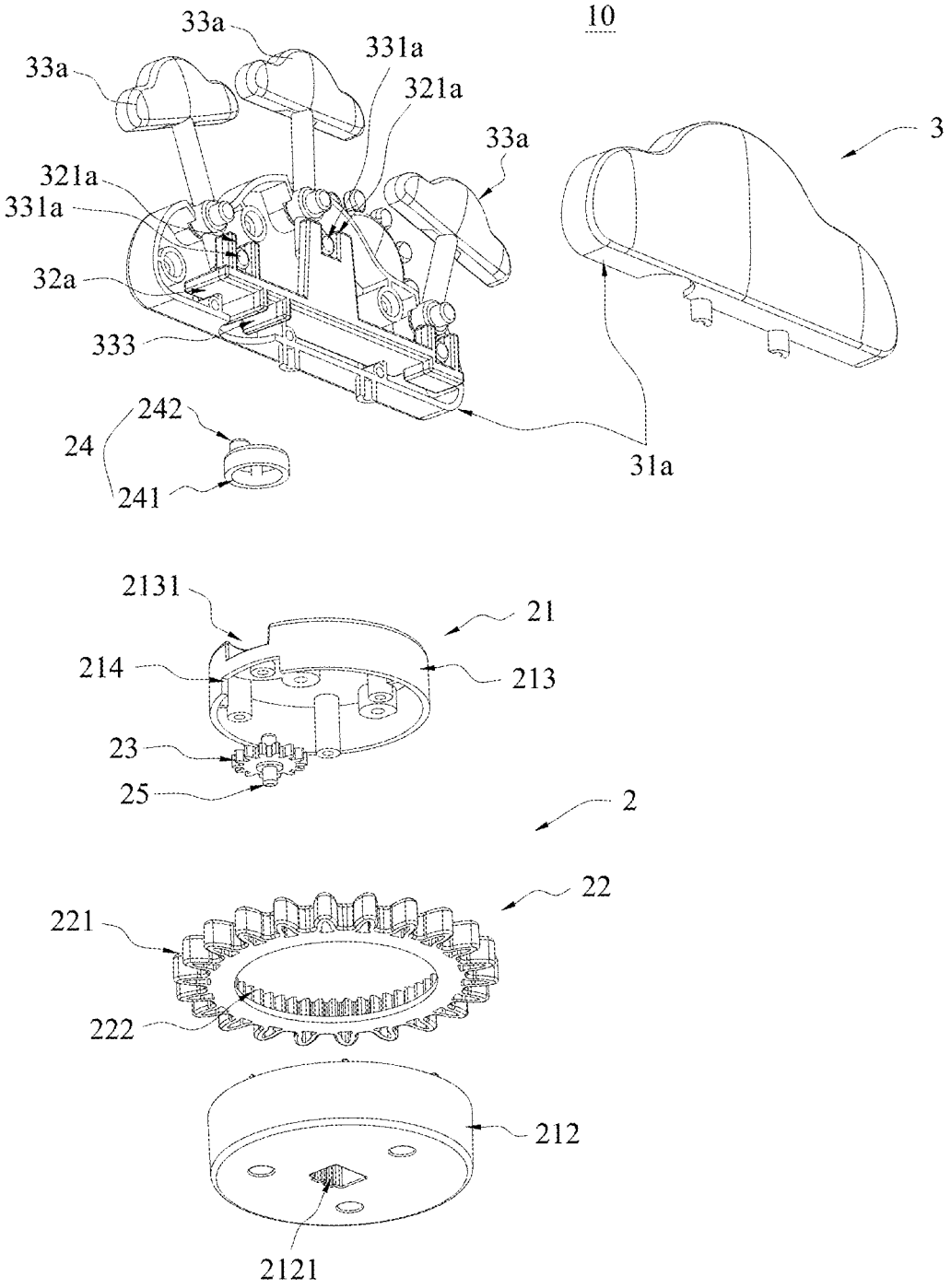
FIG. 9 is a schematic structural diagram of a transmission device and an action device in a first embodiment of the present disclosure.
Figure 10:
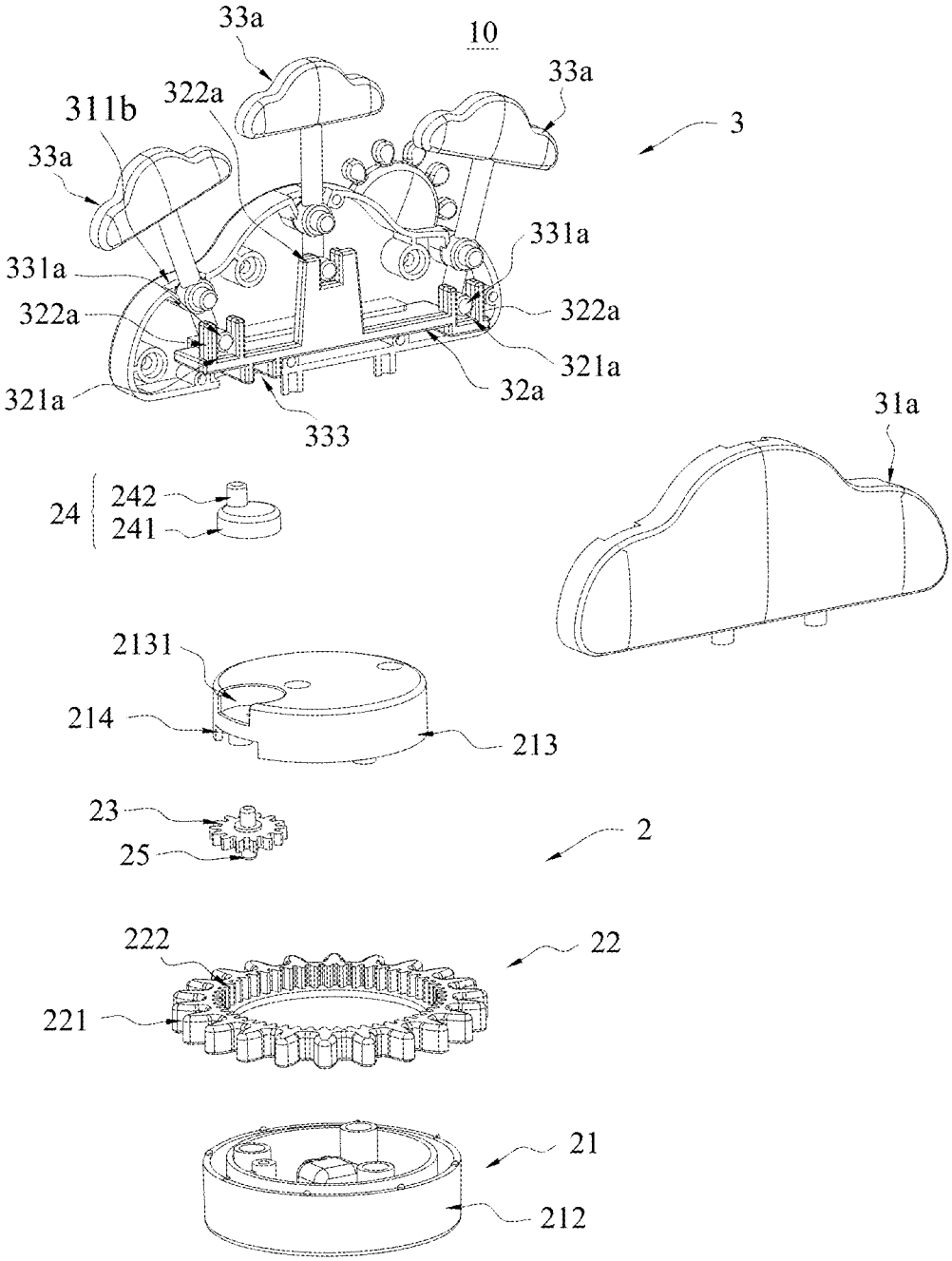
FIG. 10 is a schematic structural diagram of the interlocking toy shown in FIG. 9, viewed in another angle.
Figure 11:
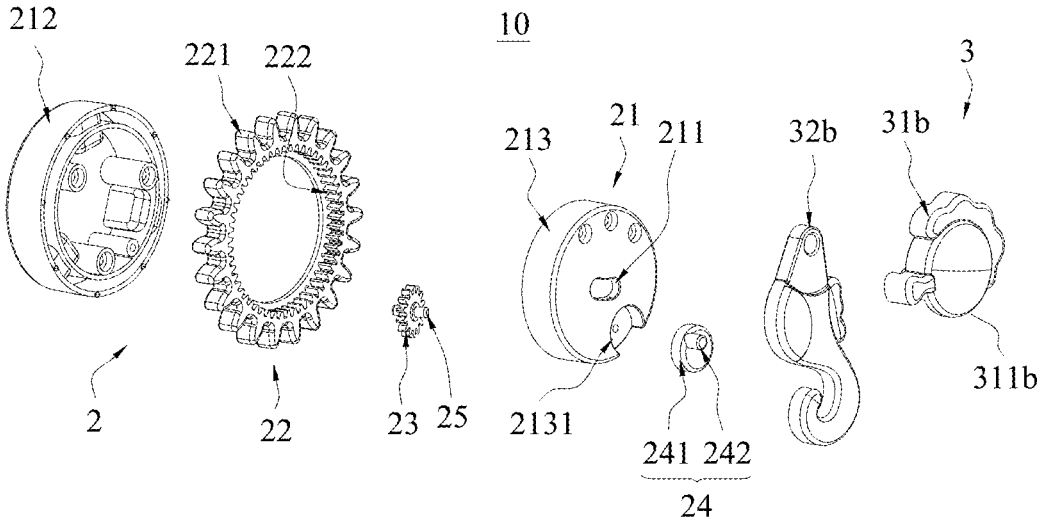
FIG. 11 is a schematic structural diagram of a transmission device and an action device in a second embodiment of the present disclosure.
Figure 12:
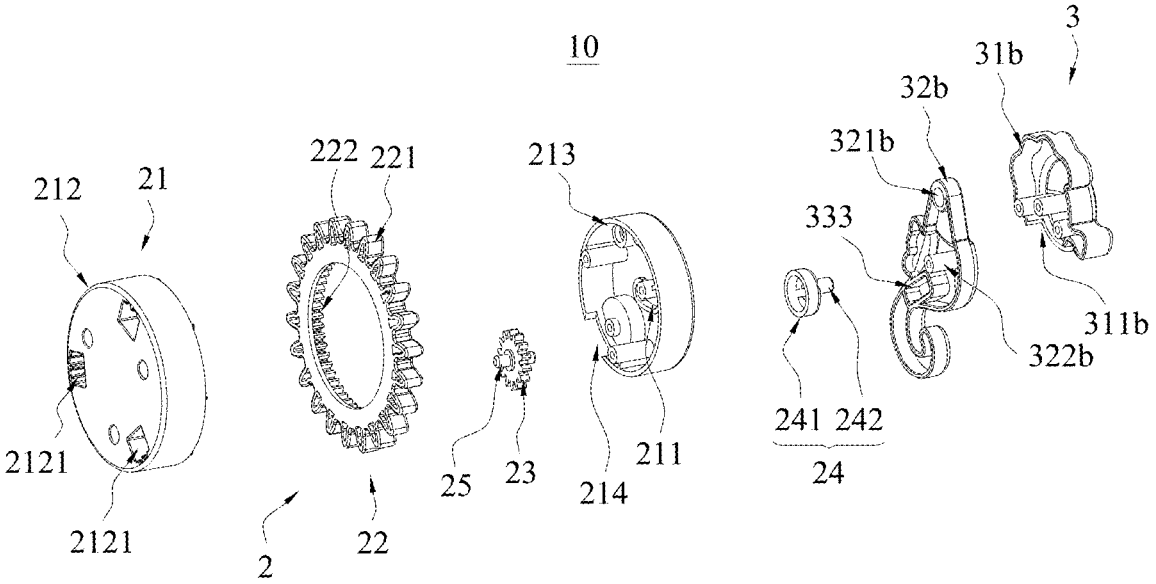
FIG. 12 is a schematic structural diagram of the interlocking toy shown in FIG. 11, viewed in another angle.

As shown in FIG. 9 and FIG. 10, in some embodiments of each action device 3, the action device 3 includes a mounting shell 31*a*, a sliding seat 32*a*, and at least one swinging member 33*a*. The driving channel 333 and at least one limiting slot 321*a* are formed in the sliding seat 32*a*. Each swinging member 33*a* is provided with a swinging part 331*a*.

The mounting shell 31*a* is arranged on the supporting seat 21. The sliding seat 32*a* is slidably arranged on the mounting shell 31*a*. Each swinging member 33*a* is rotatably arranged on the mounting shell 31*a*. The swinging part 331*a* is located in the limiting slot 321*a*.

When the sliding seat 32*a* is driven to slide by the eccentric shaft 242, the sliding seat 32*a* drives the swinging part 331*a* through a slot wall of the limiting slot 321*a*, so that the swinging part 331*a* drives the swinging member 33*a* to rotate relative to the mounting shell 31*a*.

It can be understood that the mounting shell 31*a* is used as a fixed base to support the sliding of the sliding seat 32*a* and also to support the rotation of the swinging member 33*a*. The mounting shell 31 can support the sliding of the sliding seat 32*a* through a grooved rail structure, a sliding rail structure, a sliding chute structure, or other structures capable of sliding in the existing art. The mounting shell 31*a* can support the rotation of the swinging member 33*a* through a rotating shaft or other rotary connection structures in the existing art.

It should be noted that when the sliding seat 32*a* is driven to slide by the eccentric shaft 242, the slot wall of the limiting slot 321*a* pushes the swinging part 331*a* to convert linear sliding into rotation motion of the swinging member 33*a*.

It should also be noted that a contour of the limiting slot 321*a* can be flexibly set, so that a rotation amplitude and speed curve of the swinging member 33*a* is adjusted based on the contour (such as a curved/broken line contour) of the limiting slot 321*a*, thus implementing differential action outputs of a plurality of swinging members 33*a*.

As shown in FIG. 9 and FIG. 10, in some embodiments of each action device 3, at least one U-shaped protrusion 322*a* is arranged on the sliding seat 32*a*. Each U-shaped protrusion 322*a* defines the limiting slot 321*a* on the sliding seat 32*a*. The U-shaped protrusion 322*a* movably resists against the swinging part 331*a*.

It can be understood that the U-shaped protrusion 322*a* is used as a physical limiting boundary to define the limiting slot 321*a*. The U-shaped protrusion 322*a* respectively limit the swinging part 331*a* from two opposite sides by two opposite portions, thus providing a bidirectional driving force and preventing the swinging part 331*a* from being detached.

It should be noted that the U-shaped protrusion 322*a* can be configured to be integrally formed on the sliding seat 32*a* or can be arranged on the sliding seat 32*a* by clamping, adhesion, screwing, or insertion, or by using other connection structures.

It should also be noted that appearance sizes, outlines, and arrangement positions of the U-shaped protrusions 322*a* can be flexibly set, as long as the swinging parts 331*a* can be guided to swing based on a predetermined cycle.

As shown in FIG. 9 and FIG. 10, in some embodiments of each action device 3, the sliding seat 32*a* is provided with three limiting slots 321*a*. The action device 3 includes three swinging members 33*a*. The three swinging members 33*a* are respectively rotatably arranged on the mounting shell 31*a*. The three swinging parts 331*a* are movably arranged in the three limiting slots 321*a* in a one-to-one correspondence manner.

It can be understood that the three limiting slots 321*a* independently drive the three swinging members 33*a* to swing, so that the three swinging members 33*a* can be driven to synchronously or asynchronously swing through a single input of the sliding seat 32*a*.

As shown in FIG. 11 to FIG. 18, in some other embodiments of each action device 3, an arc-shaped guide hole 211 is formed in each supporting seat 21.

Each action device 3 includes a fixed member 31*b* and a rotary member 32*b*. The fixed member 31*b* is fixedly arranged on the supporting seat 21. The driving channel 333 is located on the rotary member 32*b*. The rotary member 32*b* is provided with a rotary connection part 321*b* and a movable connection part 322*b*. The rotary connection part 321*b* is rotatably connected to the fixed member 31*b* or the supporting seat 21. The movable connection part 322*b* is movably inserted into the arc-shaped guide hole 211.

When the eccentric shaft 242 drives the rotary member 32*b* by pressing the inner wall of the driving channel 333, the rotary member 32*b* rotates around the rotary connection part 321*b*, and the movable connection part 322*b* slides along the arc-shaped guide hole 211.

It can be understood that the arc-shaped guide hole 211 is used as a curved motion track on the supporting seat 21 and plays a role in guiding the movable connection part 322*b* to move. As a rotary pivot, the rotary connection part 321*b* can cause the rotary member 32*b* to rotate around the rotary connection part 321*b*. In the rotating process of the rotary member 32*b*, the movable connection part 322*b* can slide along the arc-shaped guide hole 211, thus achieving a guide effect.

It should be noted that the limitation and guidance performed by the arc-shaped guide hole 211 on the movable connection part 322*b* can improve rotation stability of the rotary member 32*b*. In an assembling process, the arc-shaped guide hole 211 can also guide the rotary member 32*b* to be correctly aligned and mounted.

It should also be noted that the rotary connection part 321*b* can also be configured to be rotatably connected to the fixed member 31*b*. The rotary connection part 321*b* can also be configured to be rotatably connected to the supporting seat 21.

As shown in FIG. 10 to FIG. 18, in some other embodiments of each action device 3, an avoidance hole 311*b* is formed in the fixed member 31*b*, and the rotary member 32*b* is threaded into the avoidance hole 311*b* and is exposed out of the fixed member 31*b*.

It can be understood that by the arrangement of the avoidance hole 311*b*, the rotary member 32*b* is allowed to be at least partially threaded out of the fixed member 31*b*, so that the rotation of the rotary member 32*b* can be observed by a user, and intuitiveness of action feedback of a product is improved.

Figure 13:
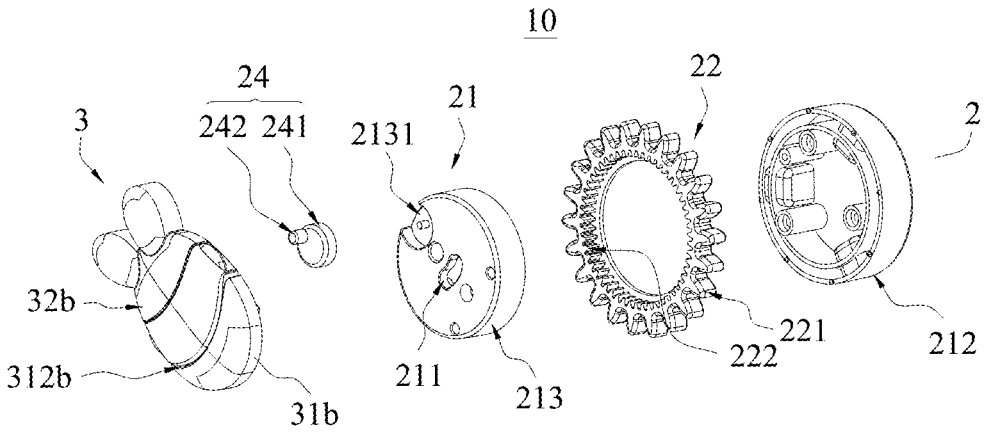
FIG. 13 is a schematic structural diagram of a transmission device and an action device in a third embodiment of the present disclosure.
Figure 14:
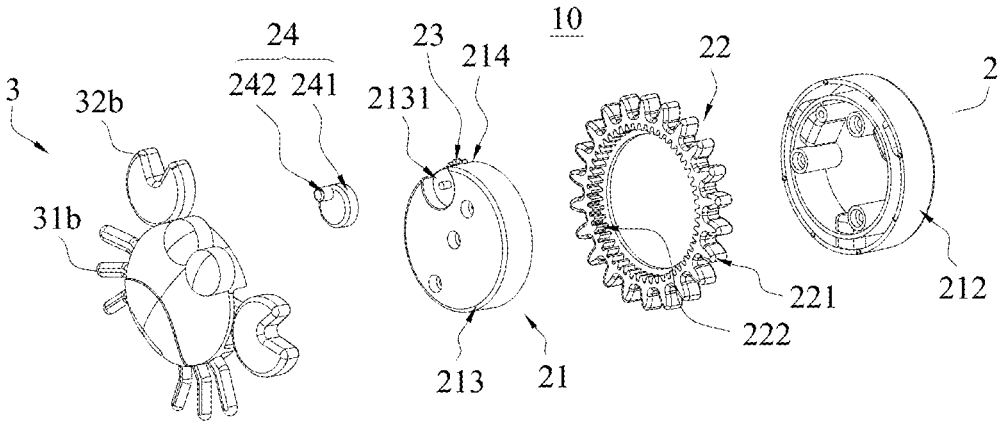
FIG. 14 is a schematic structural diagram of a transmission device and an action device in a fourth embodiment of the present disclosure.
Figure 15:
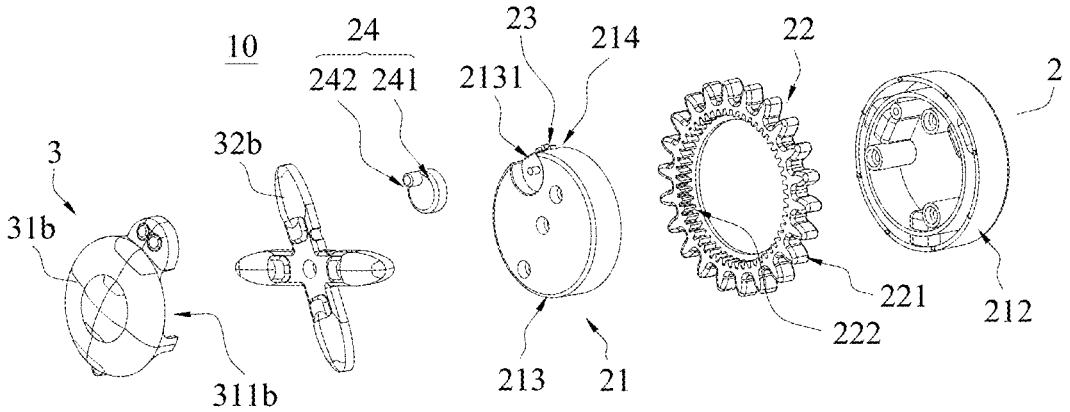
FIG. 15 is a schematic structural diagram of a transmission device and an action device in a fifth embodiment of the present disclosure.
Figure 16:
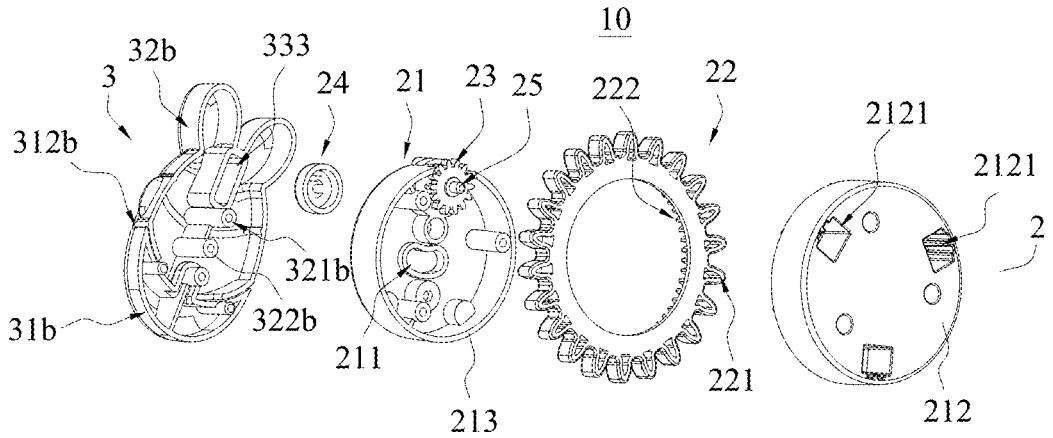
FIG. 16 is a schematic structural diagram of the interlocking toy shown in FIG. 13, viewed in another angle.
Figure 17:
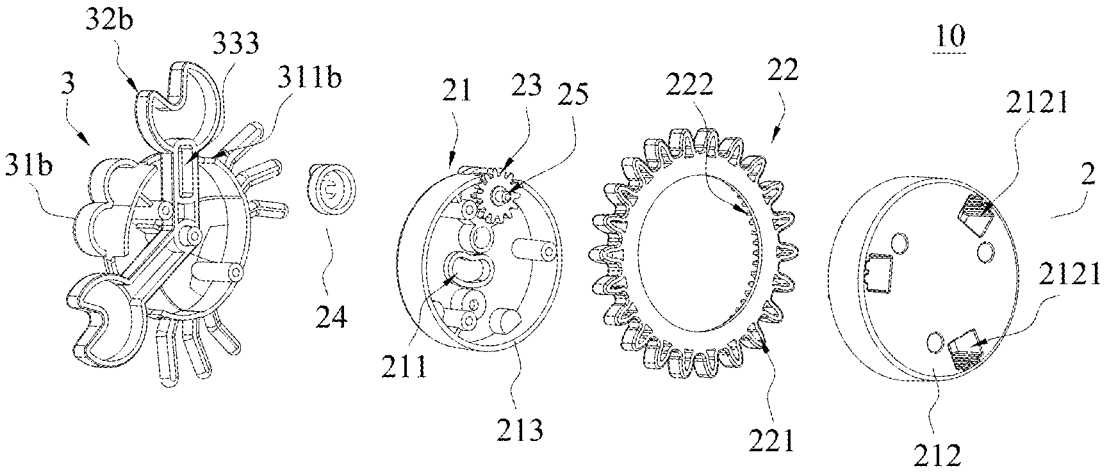
FIG. 17 is a schematic structural diagram of the interlocking toy shown in FIG. 14, viewed in another angle.
Figure 18:
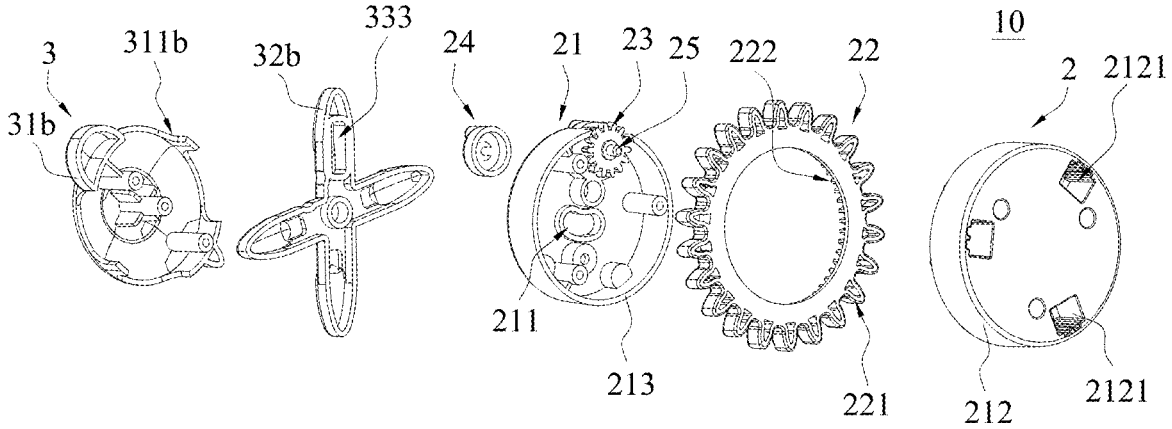
FIG. 18 is a schematic structural diagram of the interlocking toy shown in FIG. 15, viewed in another angle.

As shown in FIG. 13 and FIG. 16, in some other embodiments of each action device 3, an avoidance slot 312*b* is formed in the fixed member 31*b*. The rotary member 32*b* is at least partially located in the avoidance slot 312*b*.

It can be understood that the avoidance slot 312*b* is configured to accommodate the rotary member 32*b*, so that the rotary member 32*b* is always located in a contour space of the fixed member 31*b* during rotation, thus implementing function expansion with zero thickness increase.

It should be noted that based on the content of this embodiment, the rotary member 32*b* can be avoided from protruding on the fixed member 31*b*, and overall compactness of a product is ensured.

As shown in FIG. 19 to FIG. 22, in some other embodiments of each action device 3, each output member 24 includes an output gear 243 and an output shaft 244. The output gear 243 is rotatably arranged on the supporting seat 21, and the output gear 243 is engaged with the transmission gear 23. The output shaft 244 is arranged on the output gear 243. The output shaft 244 is in driving connection to the action device 3.

It can be understood that the output gear 243 is engaged with the transmission gear 23, so that the output gear 243 can receive the torque of the transmission gear 23. The output shaft 244 is configured to rotate under the driving of the output gear 243 and directly transfer a rotation motion to the action device 3.

Figure 19:
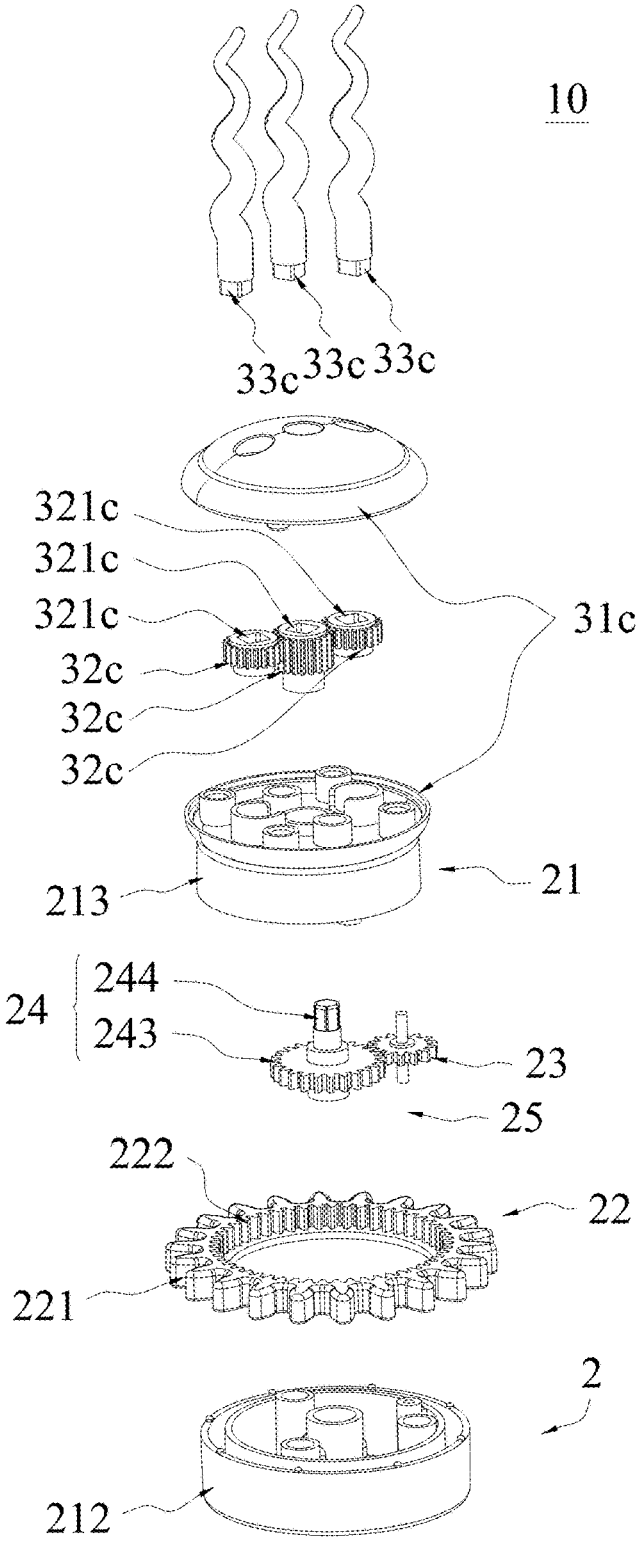
FIG. 19 is a schematic structural diagram of a transmission device and an action device in a sixth embodiment of the present disclosure.
Figure 20:
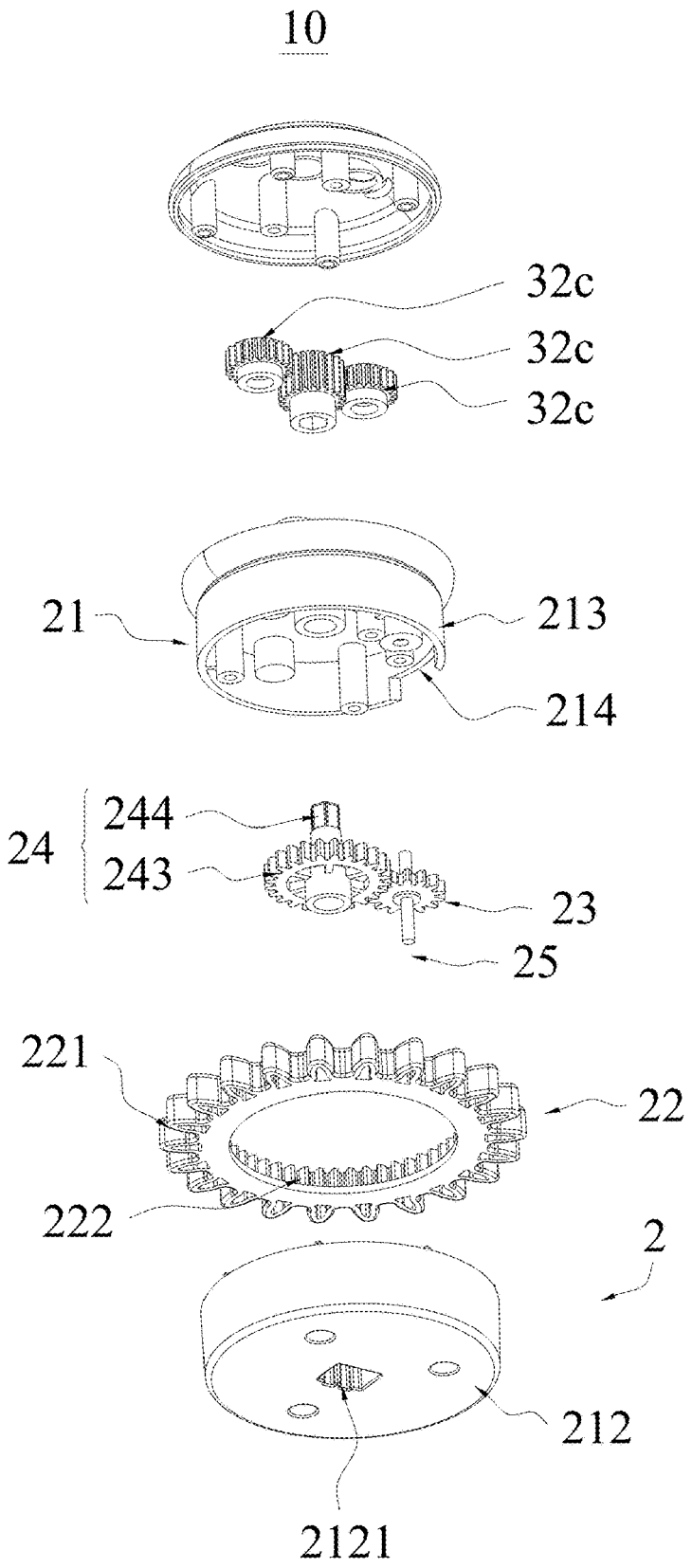
FIG. 20 is a partially schematic structural diagram of the interlocking toy shown in FIG. 19, viewed in another angle.

As shown in FIG. 19 and FIG. 20, in some other embodiments of each action device 3, the action device 3 includes a supporting shell 31*c*, a plurality of rotating gears 32*c*, and a plurality of rotating members 33*c*.

The supporting shell 31*c* is arranged on the supporting seat 21. The rotating gears 32*c* are respectively rotatably arranged on the supporting shell 31*c*, and are engaged with each other. Each output shaft 244 is in driving connection to one rotating gear 32*c*. The rotating members 33*c* are arranged on the rotating gears 32*c* in a one-to-one correspondence manner.

When the output shaft 244 rotates, the output shaft 244 drives the rotating gears 32*c* to rotate, to drive the rotating members 33*c* to rotate.

It can be understood that the rotating gears 32*c* are engaged with each other, so that the torque can be transferred to the rotating gears 32*c*, and at the same time, the rotating members 32*c* are then driven to rotate. The supporting shell 31*c* is configured to support the rotation of the rotating gears 32*c*.

It should be noted that the rotating members 33*c* can rotate together with the rotating gears 32*c* at arrangement positions. A number of teeth of each rotating gear 32*c* can be flexibly set, that is, a transmission ratio of each rotating gear 32*c* can be flexibly set, so that rotation frequencies of the rotating members 33*c* can be different. Appearances of the rotating members 33*c* can be flexibly set, and can be configured to be the same or different.

As shown in FIG. 19, in some other embodiments of each action device 3, at least one insertion hole 321*c* is formed in each rotating gear 32*c*, and the rotating members 33*c* are inserted into the insertion holes 321*c* in a one-to-one correspondence manner.

It can be understood that each insertion hole 321*c* can be configured as standardized interface, which allows plug and play mounting/replacement of the rotating member 33*c*. Further, all the insertion holes 321*c* can be configured to be of the same specification, so that insertion positions of the rotating members 33*c* can be flexibly adjusted.

As shown in FIG. 19 and FIG. 20, in some other embodiments of each action device 3, the output shaft 244 is fixedly inserted into one rotating gear 32*c*.

It can be understood that the output shaft 244 and the rotating gear 32*c* can be fixedly connected in an interference fit manner, an adhered manner, a clamped manner, or another manner.

As shown in FIG. 19 and FIG. 20, in some other embodiments of each action device 3, the output gear 243 and the output shaft 244 are of integrally formed structures.

It can be understood that the output gear 243 and the output shaft 244 that are integrally formed can avoid assembling of the output gear 243 and the output shaft 244 and improve production and assembling efficiency of a product.

Figure 21:
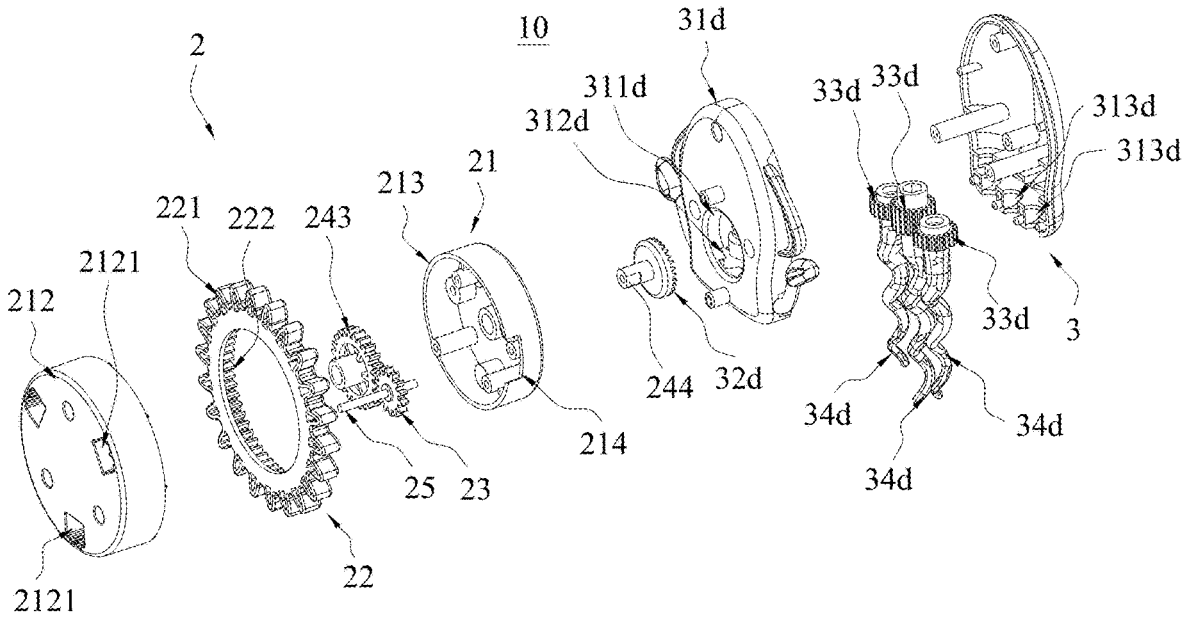
FIG. 21 is a schematic structural diagram of a transmission device and an action device in a seventh embodiment of the present disclosure.
Figure 22:
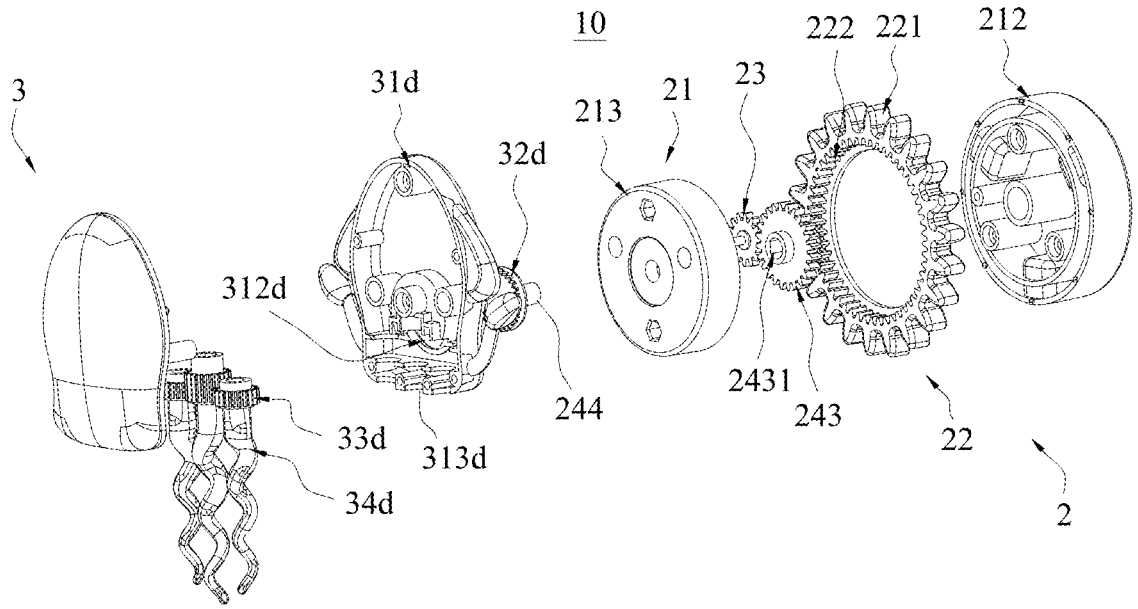
FIG. 22 is a schematic structural diagram of the interlocking toy shown in FIG. 21, viewed in another angle.
Figure 23:
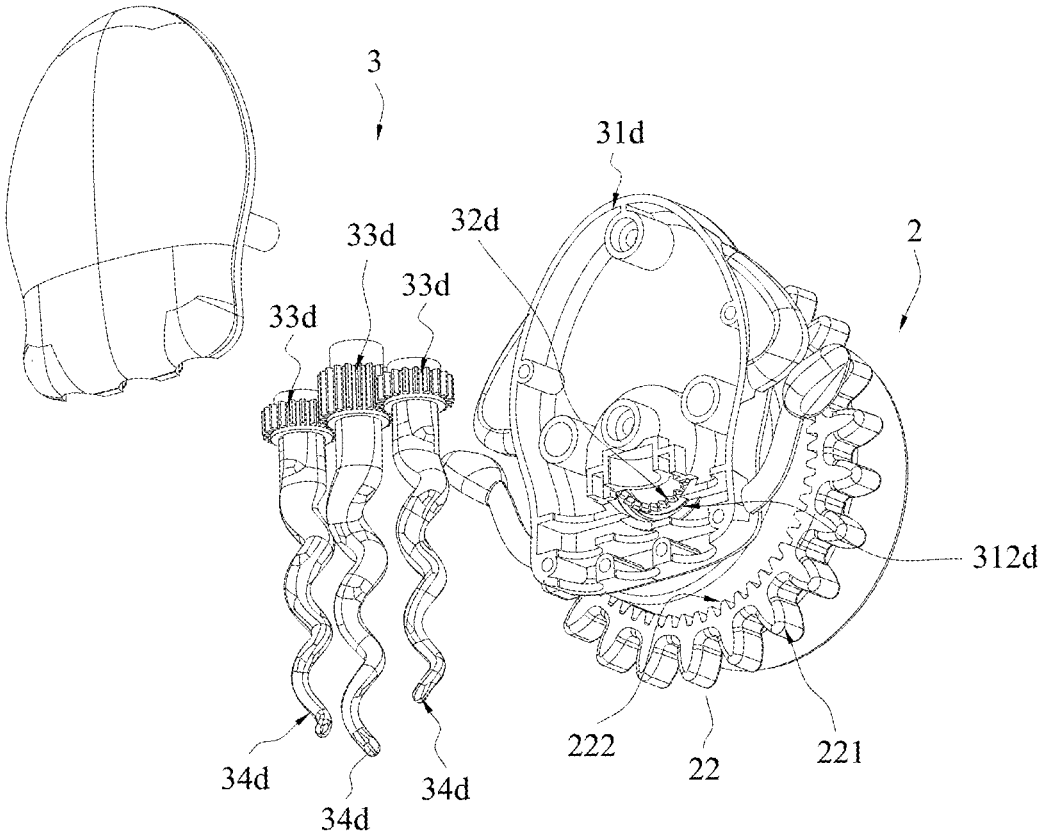
FIG. 23 is an exploded view of the interlocking toy shown in FIG. 21.

As shown in FIG. 21 to FIG. 23, in some other embodiments of each action device 3, the action device 3 includes a fixed shell 31*d*, a first reversing gear 32*d*, a plurality of second reversing gears 33*d*, and a plurality of reversing moving members 34*d*.

The fixed shell 31*d* is arranged on the supporting seat 21. The first reversing gear 32*d* is connected to the output shaft 244. The second reversing gears 33*d* are respectively rotatably arranged on the fixed shell 31*d*. One second reversing gear 33*d* is engaged with the first reversing gear 32*d*, and the second reversing gears 33*d* are engaged with each other. The reversing moving members 34*d* are respectively arranged on the second reversing gears 33*d*. A central axis of the first reversing gear 32*d* is not parallel to a central axis of any second reversing gear 33*d*.

When the output shaft 244 drives the first reversing gear 32*d* to rotate, the first reversing gear 32*d* drives the second reversing gears 33*d* to rotate, to cause the reversing moving members 34*d* to rotate relative to the fixed shell 31*d*.

It can be understood that the axis of the first reversing gear 32*d* is not parallel to the axis of the second reversing gear 33*d*, so that a rotation plane of the output shaft 244 can be converted to any space angle (for example, 90°vertical steering or 45°diagonal outputting), thus driving the reversing moving members 34*d* on another arrangement plane.

A plurality of stages of second reversing gears 33*d* are engaged with each other, so that a product can respectively transfer the torque to the reversing moving members 34*d* after reversing the power, thus implementing reversed multi-position outputting.

As shown in FIG. 21 to FIG. 23, in some other embodiments of each action device 3, the output shaft 244 is fixedly arranged on the first reversing gear 32*d*. An output hole 2431 is formed in the output gear 243. The output shaft 244 is inserted into the output hole 2431.

It can be understood that the output hole 2431 and the output shaft 244 are configured to be in plug-in fit. This can facilitate a user to quickly replace the action device 3.

As shown in FIG. 21 to FIG. 23, in some other embodiments of each action device 3, an avoidance slot 311*d* is formed in the fixed shell 31*d*. A via hole 312*d* is formed in the avoidance slot 311*d*.

The first reversing gear 32*d* is located in the avoidance slot 311*d*; and the first reversing gear 32*d* is threaded into the via hole 312*d* to be engaged with the second reversing gear 33*d*.

It can be understood that the avoidance slot 311*d* is configured to accommodate the first reversing gear 32*d*. The formation of the via hole 312*d* provides a space required for engagement between the first reversing gear 32*d* and the second reversing gear 33*d*. Due to the formation of the avoidance slot 311*d*, the first reversing gear 32*d* does not need to be arranged in the fixed shell 31*d*. Due to the formation of the via hole 312*d*, the first reversing gear 32*d* can be engaged with the second reversing gear 33*d* located in the fixed shell 31*d*.

As shown in FIG. 21 to FIG. 23, in some other embodiments of each action device 3, a plurality of through holes 313*d* are formed in the fixed shell 31*d*. The reversing moving members 34*d* are threaded into the through holes 313*d* in a one-to-one correspondence manner. The reversing moving members 34*d* are exposed out of the fixed shell 31*d*.

It can be understood that due to the formation of the through holes 313*d*, the reversing moving members 34*d* can be exposed out of the fixed shell 31*d*, so that an action of the action device 3 can be directly seen by a user, which improves intuitiveness of action feedback.

As shown in FIG. 9 to FIG. 22, in some embodiments of the interlocking toy 10, each supporting seat 21 includes a base 212 and a cover body 213. The fitting ends 2121 are located at a bottom of the supporting seat 21. Each transmission gear 23 is rotatably arranged between the base 212 and the cover body 213. Each rotating seat 22 sleeves the cover body 213. The rotating seat 22 is partially clamped between the base 212 and the cover body 213. Each output member 24 is arranged on the cover body 213.

A notch 214 is formed in the base 212 or the cover body 213. The notch 214 is aligned with the inner tooth ring 222. The transmission gear 23 is threaded out of the notch 214 and is engaged with the inner tooth ring 222. Each action device 3 is arranged on the cover body 213.

It can be understood that the base 212 and the cover body 213 provide a closed accommodating space for the transmission gear 23, to avoid intrusion of an external foreign object. Through the detachable assembling of the base 212 and the cover body 213, a gear inside a product is allowed to be quickly overhauled and replaced, and convenience of use is improved.

The fitting ends 2121 are located at the bottom of the supporting seat 21. In this way, by respectively connecting any connection assembly 11 to two supporting seats 21, a relative position between the two supporting seats 21 can be fixed, and the rotating seats 22 on the supporting seats 21 are engaged with each other, so that the torque can be transferred to the two Transmission Devices 2.

The rotating seat 22 is partially clamped between the base 212 and the cover body 213, which can prevent the rotating seat 22 from sliding on the supporting seat 21, meanwhile, it can also ensure that the rotating seat 22 can rotate, thus ensuring stable engagement between adjacent transmission devices 2. The notch 214 is aligned with the inner tooth ring 222 to provide, for the transmission gear 23, a channel for being engaged with the inner tooth ring 222, so that the rotating seat 22 can drive the transmission gear 23.

As shown in FIG. 9 to FIG. 18, in some embodiments of the interlocking toy 10, an accommodating slot 2131 is formed in a top of the cover body 213. The output member 24 is located inside the accommodating slot 2131.

It can be understood that the accommodating slot 2131 provides a settled slot type mounting space for the output member 24, thus avoiding an increase in an overall height due to a protruding structure and ensuring compactness of a product. Meanwhile, the accommodating slot 2131 can also restrain the position of the output member 24 and only reserve a degree of freedom of rotation around an axis of the output member 24.

Figure 7:
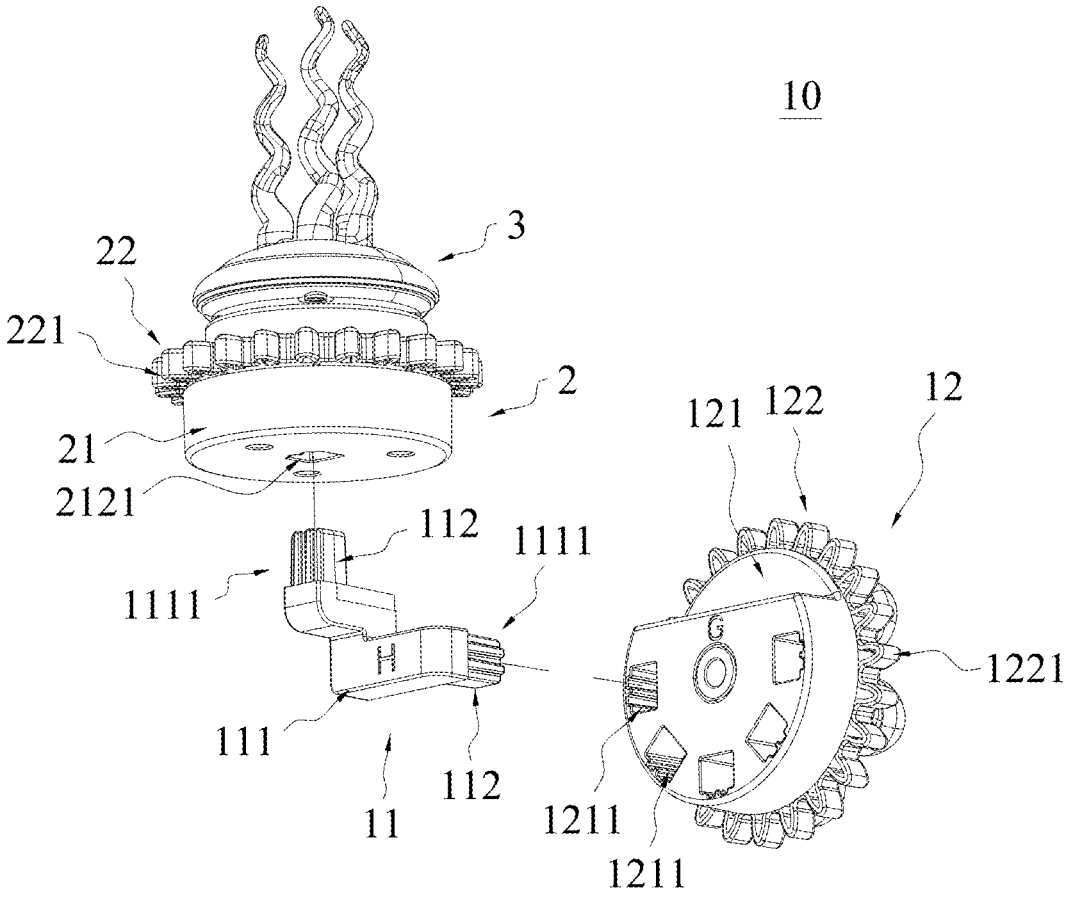
FIG. 7 is a partial exploded view of the torque transferring device, the transmission devices, and the action devices in the interlocking toy shown in FIG. 6.
Figure 8:
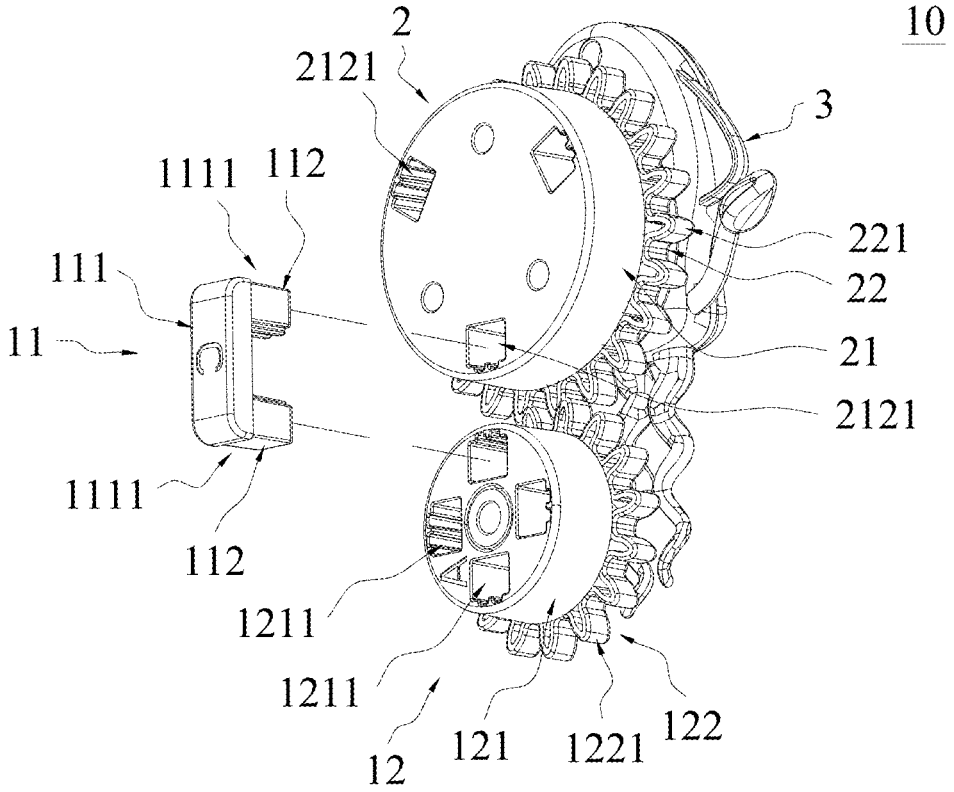
FIG. 8 is another partial exploded view of the torque transferring device, the transmission devices, and the action devices in the interlocking toy shown in FIG. 6.

As shown in FIG. 7 and FIG. 8, in some embodiments of the interlocking toy 10, each connection assembly 11 includes a connector 111. The two connection ends 1111 are respectively located on the connector 111. Each connection end 1111 is provided with a connection column 112. Positions of the two connection columns 112 can be set at least in the following manner: first, central axes of the two connection columns 112 are parallel to each other and do not overlap. Second, the central axes of the two connection columns 112 form a right angle.

It can be understood that the central axes of the two connection columns 112 are parallel to each other and do not overlap. This can implement connection of the transmission devices 2 on the same plane and implement transferring of the power on the same plane. The central axes of the two connection columns 112 form the right angle. This can implement right-angle transferring of the power, so that the power can be transferred on different planes.

As shown in FIG. 1 to FIG. 8, in some embodiments of the interlocking toy 10, the torque transferring device 1 includes a plurality of transmission assemblies 12. Each transmission assembly 12 includes a connection seat 121 and a transmission member 122. A plurality of positioning ends 1211 are provided on the connection seat 121. The positioning ends 1211 are configured for plug-in fit of the connection ends 1111. A transmission tooth structure 1221 is arranged on the transmission member 122.

When any connection assembly 11 is in plug-in fit with the positioning ends 1211 on each transmission assembly 12 through one connection end 1111, and is in plug-in fit with the fitting ends 2121 through the other connection end 1111, a relative position between the connection seat 121 and the supporting seat 21 is fixed, and the transmission tooth structure 1221 is engaged with the outer tooth ring 221, so that the transmission assembly 12 is in driving connection to the transmission device 2.

When any connection assembly 11 is respectively in plug-in fit with two transmission assemblies 12, a relative position between the two connection seats 121 is fixed, and the two transmission tooth structures 1221 are engaged with each other, so that the two transmission assemblies 12 are in driving connection to each other.

It can be understood that each connection seat 121 provides a physical carrier and a mounting reference, and each connection assembly 11 is quickly positioned and fixed through the positioning ends 1211. The positioning ends 1211 are used as standardized insertion interfaces to restrain a degree of freedom of displacement of the connection ends 1111. Each transmission member 122 is configured to bear the power, and engaged transferring of the torque is implemented through each transmission tooth structure 1221.

It should be noted that when the transmission tooth structure 1221 is engaged with the outer tooth ring 221 of the transmission device 2, a driving link for the transmission assembly 12 and the transmission device 2 is established. When the transmission tooth structure 1221 is engaged with the transmission tooth structure 1221 of another transmission assembly 12, direct torque transferring between the transmission assemblies 12 is implemented.

As shown in FIG. 1 to FIG. 5, in some embodiments of the interlocking toy 10, the interlocking toy 10 further includes a vehicle body 4 and a driving device 5.

At least some of the connection seats 121 are arranged on the vehicle body 4.

The driving device 5 includes a motor 51 and a plurality of driving gears 52. The motor 51 is arranged on the vehicle body 4. The driving gears 52 are respectively rotatably arranged on the vehicle body 4. The driving gears 52 are engaged with each other in sequence. The motor 51 is in driving connection to one driving gear 52. Another driving gear 52 is in driving connection to the transmission members 122.

It can be understood that the vehicle body 4 is configured to support the transmission devices 2. The transmission devices 2 can be stably supported through the vehicle body 4, so that the transmission devices 2 can stably rotate. The driving device 5 is configured to output a torque during working, thereby driving the transmission members 122, which are located on the vehicle body 4 in the torque transferring path, to rotate, so that the torque can be transferred to subsequent transmission assemblies 12, transmission devices 2, and action devices 3 through the transmission assemblies 12.

The motor 51 is configured to output the torque to the driving gears 52 when electrified to work, and then the torque is transferred to the transmission members 122 through the engaged driving gears 52.

Further, in some embodiments of the driving device 5, some driving gears can be connected through rotating shafts. In this way, torque transferring can also be implemented between every two driving gears. Specific gear types, numbers of teeth, and other specifications of the driving gears can be flexibly set and are adjusted specifically based on an appearance size of the vehicle body 4 and a required transmission ratio.

Further, in some embodiments of the driving device 5, the driving device 5 can also be configured to include a manual input device. The manual input device is arranged on the transmission members 122. A user can carry out manual inputting through the manual input device, so that a torque can be transferred to the action devices 3.

Figure 2:
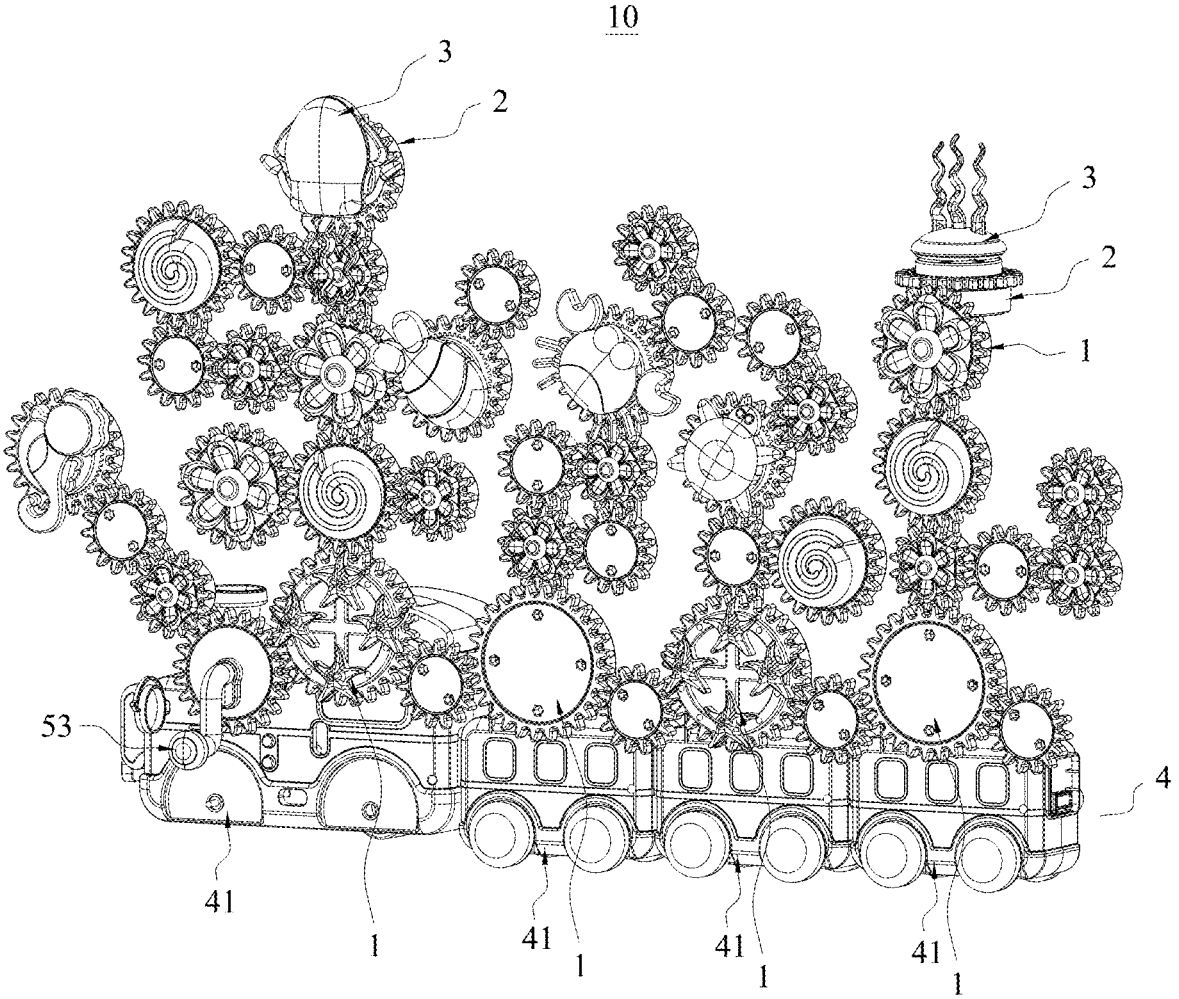
FIG. 2 is a schematic structural diagram of an interlocking toy in some other embodiments of the present disclosure.
Figure 3:
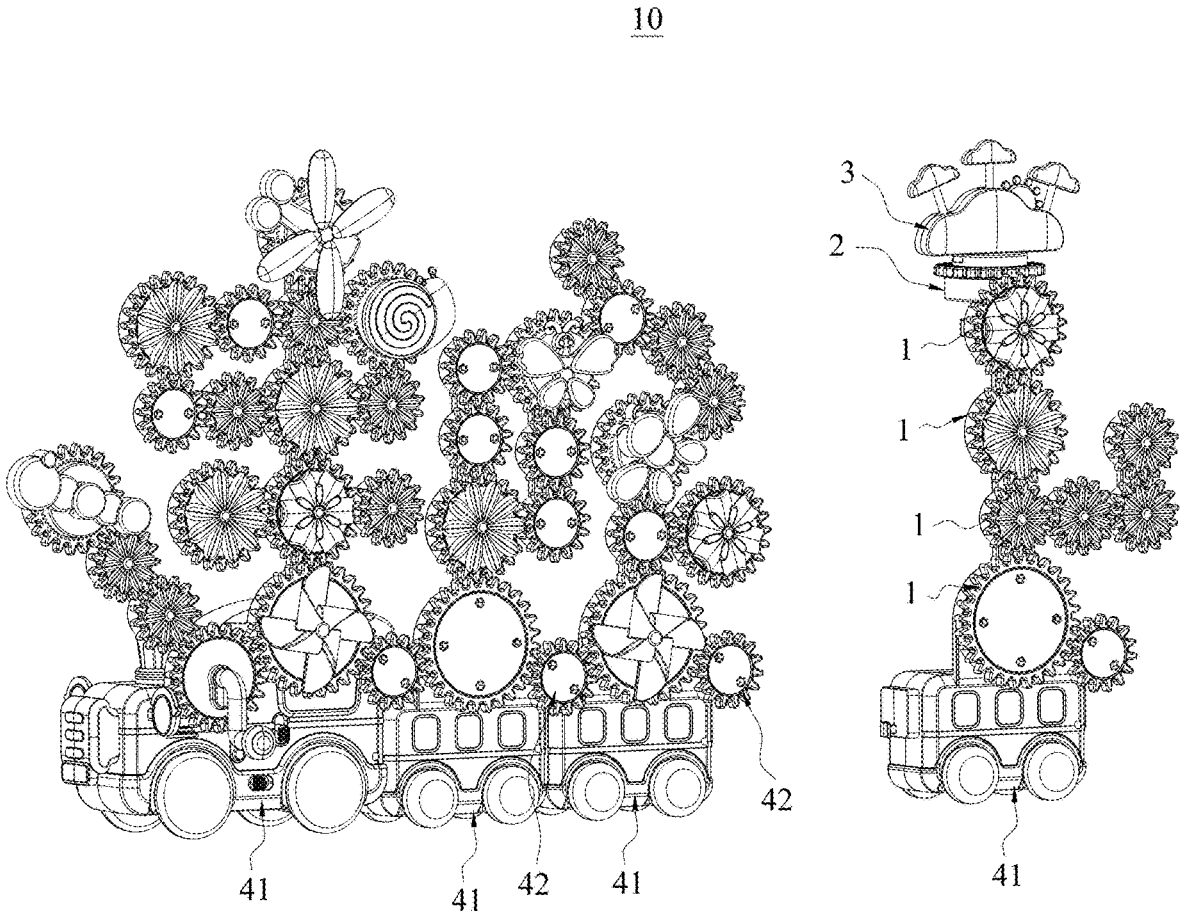
FIG. 3 is a schematic structural diagram of an interlocking toy which is in a state in some embodiments of the present disclosure.
Figure 4:
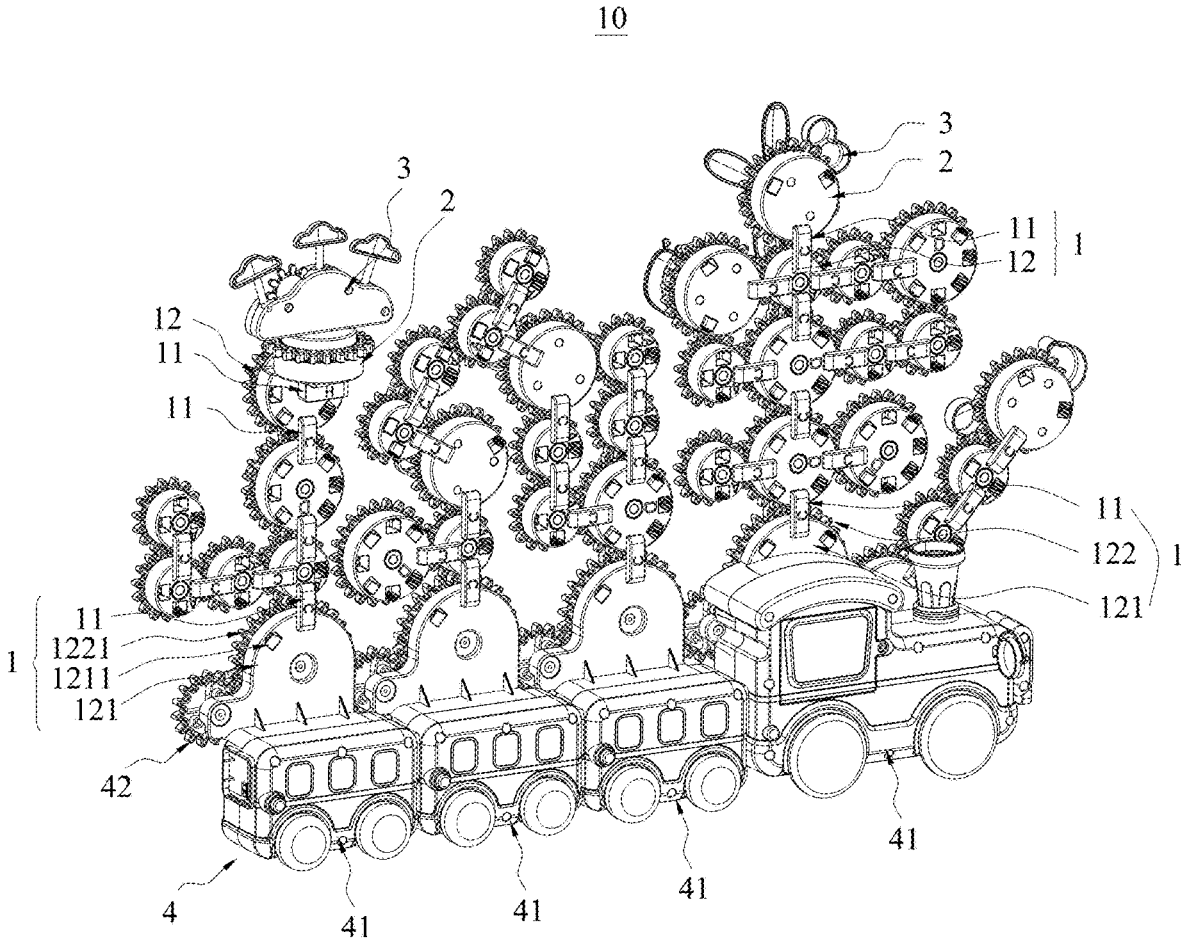
FIG. 4 is a schematic structural diagram of the interlocking toy shown in FIG. 1, viewed in another angle.
Figure 5:
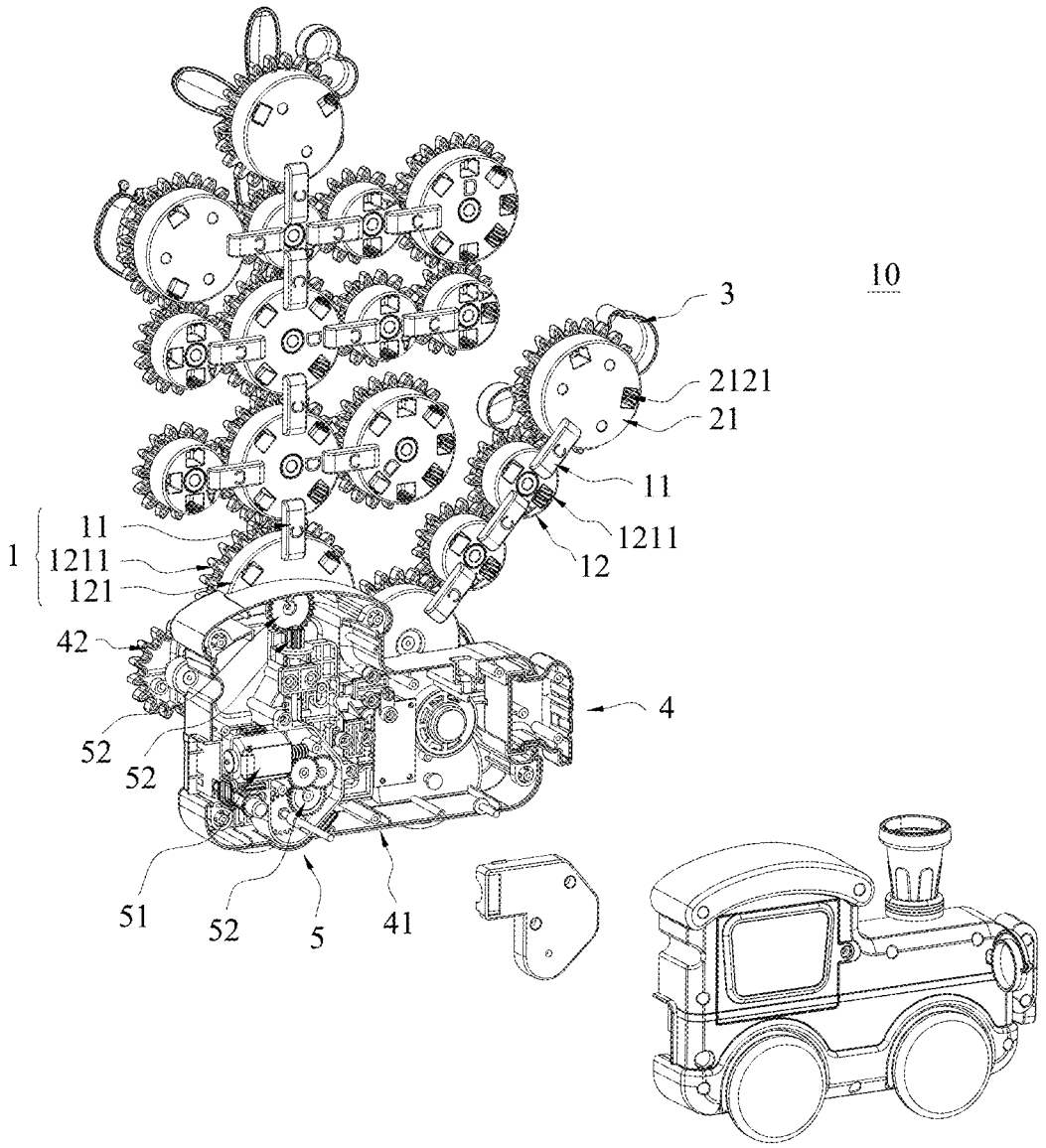
FIG. 5 is a partially structural exploded view of an interlocking toy in some other embodiments of the present disclosure.
Figure 6:
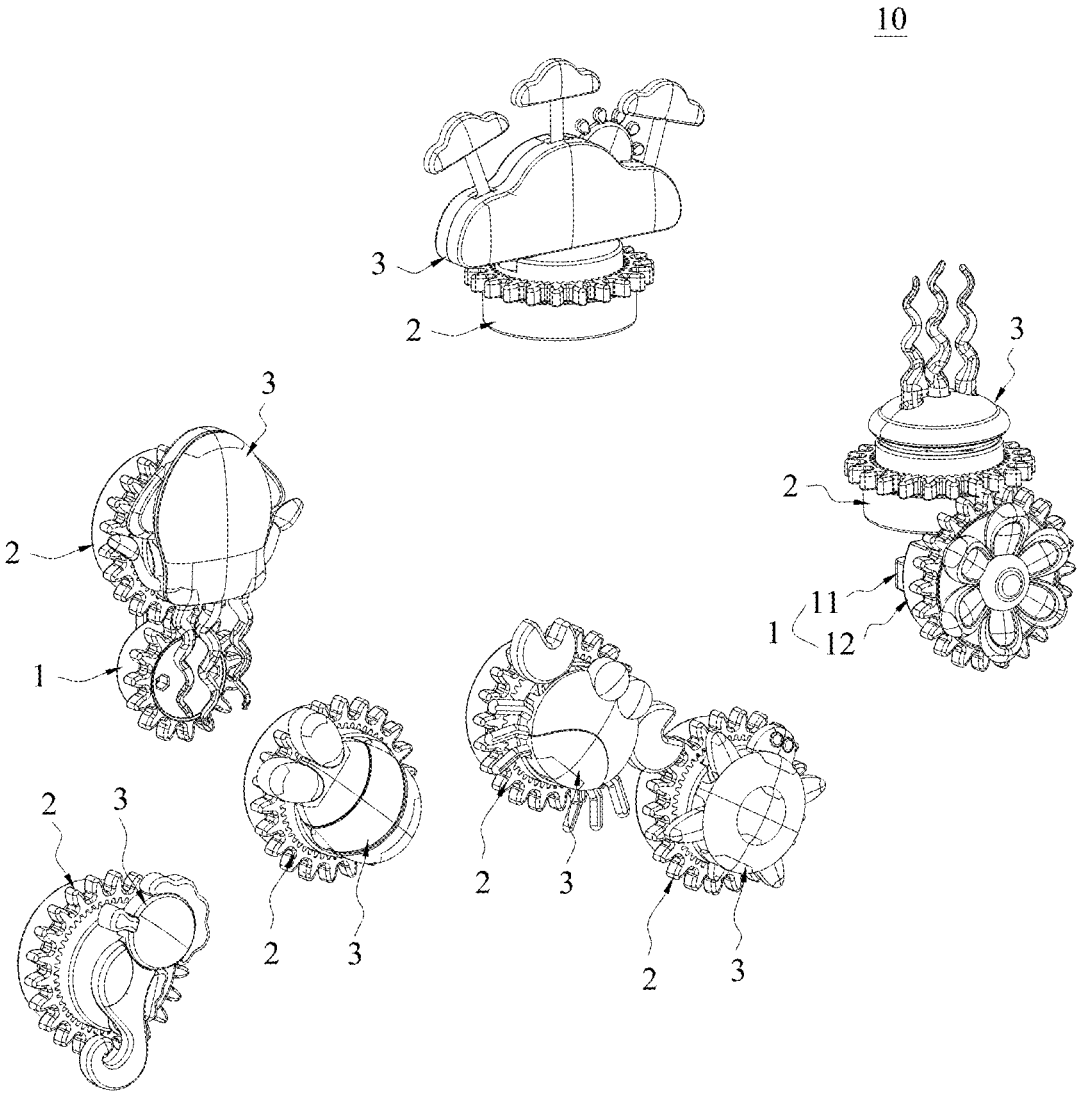
FIG. 6 is a schematic structural diagram of a torque transferring device, transmission devices, and action devices in some other embodiments of the present disclosure.

Specifically, as shown in FIG. 1 and FIG. 2, the manual input device can be configured to include a rotary grip 53 which is arranged on the transmission members 122. In this way, a user can drive the transmission members 122 to rotate through the rotary grip to input a torque.

As shown in FIG. 1 to FIG. 5, in some embodiments of the interlocking toy 10, the vehicle body 4 includes a plurality of vehicle assemblies 41 which are detachably connected to each other.

The driving device 5 is arranged on one vehicle assembly 41. The connection seats 121 are arranged on at least some of the vehicle assemblies 41.

It can be understood that the vehicle assemblies 41 can be connected in an insertion connection manner, a snap-in connection manner, a magnetic attraction connection manner, a lock pin connection manner, or another connection manner in the existing art. In this way, a user can flexibly adjust an arrangement sequence and relative positions of the vehicle assemblies 41, which further improves appearance change flexibility of a product.

It should be noted that the connection seats 121 are arranged on at least some of the vehicle assemblies 41. Each connection seat 121 is provided with the transmission member 122. The vehicle assemblies 41 provided with the transmission assemblies 12 can also be connected to the transmission devices 2 through the positioning ends 1211 on the transmission assemblies 12, that is, at least some of the vehicle assemblies 41 can also be correspondingly provided with the transmission devices 2. Further, in some embodiments, intermediate gear structures 42 can be arranged on the vehicle assemblies 41. The intermediate gear structures 42 are engaged with the transmission tooth structures 1221 on the vehicle assemblies 41. After two vehicle assemblies 41 (which are the vehicle assemblies 41 provided with the transmission assemblies 12) are aligned and assembled, the transmission tooth structures 1221 on the two vehicle assemblies 41 are indirectly engaged through the intermediate gear structures 42, so that the two transmission tooth structures 1221 can transfer a torque through the intermediate gear structures 42.

It should be further noted that after the two vehicle assemblies 41 provided with the transmission assemblies 12 are in abutment fit, a further configuration can be made: first, the intermediate gear structures 42 on the two vehicle assemblies 41 are engaged with each other, so that the transmission tooth structures 1221 on the two vehicle assemblies 41 can also be indirectly engaged to implement torque transferring. Second, the intermediate gear structure 42 on one vehicle assembly 41 makes the two transmission tooth structures 1221 engaged respectively (the intermediate gear structure 42 is engaged with the transmission tooth structure 1221 at the arrangement position), so that the transmission devices 2 on the two vehicle assemblies 41 can also be engaged to implement torque transferring. When either of the foregoing manners is used to arrange the intermediate gear structures 42, the torque outputted by the single driving device 5 can be correspondingly transferred to the transmission devices 2 and the action devices 3 on the vehicle assemblies 41. While the appearance change flexibility of the product is improved, it is still not necessary to increase the quantity of the motor 51, so that an excessive increase of product costs is avoided.

In some embodiments, to improve the convenience of use of products, identifiers for recognition can be set on the same type of elements. For example, graphic symbols, letter symbols, numerical symbols, or other identifiers capable of being recognized by a user are set on a surface of a product, so that a user can quickly identify and classify the same type of elements and is assisted in quickly searching for and locating the elements. This improves product interlocking efficiency.

In some embodiments, each of some transmission devices 2 can be configured to be provided with only one fitting end 2121. In this way, this transmission device 2 with the single fitting end 2121 can be correspondingly arranged at a tail end of the torque transferring path. Certainly, the mentioned tail end of the torque transferring path is a tail end that is customized by a user in an interlocking process. When the torque is transferred to the tail end, the action device 3 on the transmission device 2 can be driven to work and perform a predetermined action. In addition, in an actual interlocking process, a user can flexibly interlock parts to form tail ends of a plurality of torque transferring paths.

The present disclosure has the following beneficial effects:

An interlocking toy is provided. A plurality of connection assemblies of a torque transferring device are arranged on the interlocking toy. Each connection assembly is provided with two connection ends, and a plurality of fitting ends are provided on a supporting seat. Each fitting end is configured for detachable insertion of the connection ends. Thus, transmission devices are allowed to be replaced or rearranged, which improves transformability of the toy and enhances transformation flexibility of a product.

Second, when any connection assembly is in plug-in fit with the fitting ends of two supporting seats respectively through the two connection ends, a relative position between the two supporting seats is fixed, so that outer tooth rings of two rotating seats are engaged with each other, and then two transmission devices are in driving connection to each other. Thus, a single torque inputting structure outputs a torque to the transmission devices that are engaged with each other, and the torque is then further distributed to the action devices. In this way, arrangement of a plurality of independent torque inputting structures is reduced, which means that arrangement of a plurality of motors is avoided. Manufacturing costs of the product are greatly reduced, and compactness of the product is improved.

The schemes of the present disclosure have been described in more details above with reference to the accompanying drawings. In the foregoing embodiments, the description of each embodiment has respective focuses. For a part that is not described in detail in an embodiment, reference may be made to related descriptions in other embodiments. Those skilled in the art should also be aware that the actions and modules involved in this specification may not be necessary for the present disclosure. Furthermore, it can be understood that the steps in the method of the embodiments of the present disclosure can be sequentially adjusted, merged, and deleted according to actual needs. The modules in the device of the embodiments of the present disclosure can be merged, partitioned, and deleted according to actual needs.

The above has described the various embodiments of the present disclosure. The above explanation is exemplary, not exhaustive, and is not limited to the various embodiments disclosed herein. Many modifications and changes are obvious to those of ordinary skill in the art without deviating from the scope and spirit of the various embodiments described herein. The selection of the terms used herein aims to best explain the principles and practical applications of the various embodiments or improvements to technologies in the market, or to enable other persons of ordinary skill in the art to understand the various embodiments disclosed herein.

What is claimed is:

1. An interlocking toy, comprising:

a torque transferring device, comprising a plurality of connection assemblies, wherein each connection assembly is provided with two connection ends;

a plurality of transmission devices, wherein each transmission device comprises a supporting seat, a rotating seat, a transmission gear, and an output member;

each supporting seat is provided with a plurality of fitting ends; each fitting end is configured for detachable insertion of the connection ends; each rotating seat has an outer tooth ring and an inner tooth ring; each rotating seat is rotatably arranged on a supporting seat; each transmission gear is rotatably arranged on a supporting seat; each transmission gear is engaged with an inner tooth ring; each transmission gear is in driving connection to an output member; and a plurality of action devices, wherein each action device is movably arranged on a supporting seat in a one-to-one correspondence manner, and each action device is in driving connection to an output member in a one-to-one correspondence manner, wherein when any connection assembly is in plug-in fit with fitting ends of two supporting seats respectively through two connection ends, a relative position between two supporting seats is fixed, so that two outer tooth rings are engaged with each other, and then two transmission devices are in driving connection to each other.

2. The interlocking toy according to claim 1, wherein each output member comprises a rotating wheel and an eccentric shaft; each transmission device further comprises a transmission shaft; each transmission shaft is threaded and fixed in a transmission gear; each transmission shaft is rotatably arranged on a supporting seat, and each transmission shaft is fixedly connected to a rotating wheel; each eccentric shaft is arranged on a rotating wheel; each eccentric shaft is in driving connection to the each action device; or each output member comprises a rotating wheel and an eccentric shaft; each transmission device further comprises a transmission shaft that is integrally formed on a transmission gear; each transmission shaft is rotatably arranged on a supporting seat, and each transmission shaft is fixedly connected to a rotating wheel; each eccentric shaft is arranged on a rotating wheel; and each eccentric shaft is in driving connection to the each action device.

3. The interlocking toy according to claim 2, wherein a driving channel is formed in each action device; each eccentric shaft is movably inserted into a driving channel; and when each transmission gear is driven to rotate by a rotating seat, each rotating wheel is driven to rotate through a transmission shaft, so that each rotating wheel drives a eccentric shaft to move along a driving channel, and each eccentric shaft drives an action device to move by pressing an inner wall of a driving channel.

4. The interlocking toy according to claim 3, wherein each action device comprises a mounting shell, a sliding seat, and at least one swinging member; a driving channel and at least one limiting slot are formed in a sliding seat; each swinging member is provided with a swinging part;

each mounting shell is arranged on a supporting seat; each sliding seat is slidably arranged on a mounting shell; each swinging member is rotatably arranged on a mounting shell; each swinging part is located in a limiting slot; and when each sliding seat is driven to slide by an eccentric shaft, each sliding seat drives a swinging part through a slot wall of a limiting slot, so that each swinging part drives a swinging member to rotate relative to a mounting shell.

5. The interlocking toy according to claim 4, wherein at least one U-shaped protrusion is arranged on a sliding seat; each U-shaped protrusion defines a limiting slot on a sliding seat; each U-shaped protrusion movably resists against a swinging part; and/or, each sliding seat is provided with three limiting slots; each action device comprises three swinging members; the three swinging members are respectively rotatably arranged on a mounting shell; and three swinging parts are movably arranged in three limiting slots in a one-to-one correspondence manner.

6. The interlocking toy according to claim 3, wherein an arc-shaped guide hole is formed in each supporting seat;

each action device comprises a fixed member and a rotary member; each fixed member is fixedly arranged on a supporting seat; each driving channel is located on a rotary member; each rotary member is provided with a rotary connection part and a movable connection part; each rotary connection part is rotatably connected to a fixed member or a supporting seat; each movable connection part is movably inserted into an arc-shaped guide hole; and when each eccentric shaft drives a rotary member by pressing an inner wall of each driving channel, each rotary member rotates around a rotary connection part, and each movable connection part slides along an arc-shaped guide hole.

7. The interlocking toy according to claim 6, wherein an avoidance hole is formed in a fixed member, and each rotary member is threaded into an avoidance hole and is exposed out of a fixed member; or, an avoidance slot is formed in a fixed member; and each rotary member is at least partially located in an avoidance slot.

8. The interlocking toy according to claim 1, wherein each output member comprises an output gear and an output shaft; each output gear is rotatably arranged on a supporting seat, and each output gear is engaged with a transmission gear; each output shaft is arranged on an output gear; and each output shaft is in driving connection to an action device.

9. The interlocking toy according to claim 8, wherein each action device comprises a supporting shell, a plurality of rotating gears, and a plurality of rotating members;

each supporting shell is arranged on a supporting seat; the rotating gears are respectively rotatably arranged on a supporting shell, and are engaged with each other; each output shaft is in driving connection to one rotating gear; the rotating members are arranged on the rotating gears in a one-to-one correspondence manner; and when each output shaft rotates, each output shaft drives the rotating gears to rotate, to drive the rotating members to rotate.

10. The interlocking toy according to claim 9, wherein at least one insertion hole is formed in each rotating gear, and the rotating members are inserted into insertion holes in a one-to-one correspondence manner; and/or, each output shaft is fixedly inserted into one rotating gear; and/or, each output gear and each output shaft are of integrally formed structures.

11. The interlocking toy according to claim 8, wherein each action device comprises a fixed shell, a first reversing gear, a plurality of second reversing gears, and a plurality of reversing moving members;

each fixed shell is arranged on a supporting seat; each first reversing gear is connected to an output shaft; the second reversing gears are respectively rotatably arranged on a fixed shell; one second reversing gear is engaged with a first reversing gear, and the second reversing gears are engaged with each other; the reversing moving members are respectively arranged on the second reversing gears; a central axis of each first reversing gear is not parallel to a central axis of any second reversing gear; and when each output shaft drives a first reversing gear to rotate, each first reversing gear drives the second reversing gears to rotate, to cause the reversing moving members to rotate relative to a fixed shell.

12. The interlocking toy according to claim 11, wherein each output shaft is fixedly arranged on a first reversing gear; an output hole is formed in an output gear; and each output shaft is inserted into an output hole.

13. The interlocking toy according to claim 11, wherein an avoidance slot is formed in a fixed shell; a via hole is formed in an avoidance slot;

each first reversing gear is located in an avoidance slot; and each first reversing gear is threaded into a via hole to be engaged with a second reversing gear.

14. The interlocking toy according to claim 11, wherein a plurality of through holes are formed in a fixed shell; the reversing moving members are threaded into the through holes in a one-to-one correspondence manner; and the reversing moving members are exposed out of a fixed shell.

15. The interlocking toy according to claim 1, wherein each supporting seat comprises a base and a cover body; the fitting ends are located at a bottom of each supporting seat; each transmission gear is rotatably arranged between a base and a cover body; each rotating seat sleeves a cover body; each rotating seat is partially clamped between a base and a cover body; each output member is arranged on a cover body;

a notch is formed in each base or each cover body; each notch is aligned with an inner tooth ring; each transmission gear is threaded out of a notch and is engaged with an inner tooth ring; and each action device is arranged on a cover body.

16. The interlocking toy according to claim 15, wherein an accommodating slot is formed in a top of a cover body; and each output member is located inside an accommodating slot.

17. The interlocking toy according to claim 1, wherein each connection assembly comprises a connector; the two connection ends are respectively located on a connector; each connection end is provided with a connection column;

central axes of the two connection columns are parallel to each other and do not overlap; or the central axes of the two connection columns form a right angle.

18. The interlocking toy according to claim 1, wherein the torque transferring device comprises a plurality of transmission assemblies; each transmission assembly comprises a connection seat and a transmission member; a plurality of positioning ends are provided on a connection seat; the positioning ends are configured for plug-in fit of the connection ends; a transmission tooth structure is arranged on a transmission member;

when any connection assembly is in plug-in fit with the positioning ends on each transmission assembly through one connection end, and is in plug-in fit with the fitting ends through the other connection end, a relative position between a connection seat and a supporting seat is fixed, and the transmission tooth structure is engaged with an outer tooth ring, so that each transmission assembly is in driving connection to a transmission device;

when any connection assembly is respectively in plug-in fit with two transmission assemblies, a relative position between the two connection seats is fixed, and the two transmission tooth structures are engaged with each other, so that the two transmission assemblies are in driving connection to each other.

19. The interlocking toy according to claim 18, wherein the interlocking toy further comprises a vehicle body and a driving device;

at least some of the connection seats are arranged on the vehicle body;

the driving device comprises a motor and a plurality of driving gears; the motor is arranged on the vehicle body; the driving gears are respectively rotatably arranged on the vehicle body;

the driving gears are engaged with each other in sequence; the motor is in driving connection to one driving gear; and another driving gear is in driving connection to the transmission members.

20. The interlocking toy according to claim 19, wherein the vehicle body comprises a plurality of vehicle assemblies; the vehicle assemblies are detachably connected to each other;

the driving device is arranged on one vehicle assembly; and the connection seats are arranged on at least some of the vehicle assemblies.

* * * * *